US012742604B2

(12) United States Patent
Underwood et al.

(10) Patent No.: US 12,742,604 B2
(45) Date of Patent: Sep. 22, 2026

(54) FIREARM MAGAZINE ASSEMBLIES

(71) Applicants: James Matthew Underwood, Kennesaw, GA (US); Salvador Ochoa, Powder Springs, GA (US); Larry Cullen Underwood, Canton, GA (US)

(72) Inventors: James Matthew Underwood, Kennesaw, GA (US); Salvador Ochoa, Powder Springs, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 18/988,142

(22) Filed: Dec. 19, 2024

(65) Prior Publication Data

US 2025/0207881 A1 Jun. 26, 2025

Related U.S. Application Data

(60) Provisional application No. 63/614,003, filed on Dec. 22, 2023.

(51) Int. Cl.
*F41A 9/70* (2006.01)

(52) U.S. Cl.
CPC ..... *F41A 9/70* (2013.01)

(58) Field of Classification Search
CPC ..... F41A 9/69; F41A 9/70; F41A 9/71
USPC ..... 42/50
See application file for complete search history.

(56) References Cited

U.S. PATENT DOCUMENTS 1,804,511 A 5/1931 Pedersen
3,177,601 A * 4/1965 Meunier ..... F41A 17/36 42/18
3,196,568 A * 7/1965 Reed ..... F41A 9/68 42/50
3,226,869 A 1/1966 Musgrave
3,772,812 A * 11/1973 Day ..... F41A 9/71 42/49.02
4,058,922 A * 11/1977 Elbe ..... F41A 11/02 42/16
4,139,958 A * 2/1979 Foote ..... F41A 9/71 42/49.02
4,297,800 A * 11/1981 Atchisson ..... F41A 9/71 42/49.02
4,888,899 A 12/1989 Chesnut et al.
5,386,657 A 2/1995 Racheli
6,070,352 A 6/2000 Daigle
7,621,063 B2 11/2009 Fitzpatrick et al.
7,908,780 B2 3/2011 Fitzpatrick et al.
8,028,455 B1 10/2011 Battaglia
(Continued)

FOREIGN PATENT DOCUMENTS

GB 573429 A * 11/1945 ..... F41A 9/67

OTHER PUBLICATIONS

Jeff Gurwitch; AR Magazines: Separating the Good From the Bad; S.W.A.T. Magazine; accessed online Dec. 19, 2019; https://www.swatmag.com/article/ar-magazines-separating-good-bad/.

*Primary Examiner* — John Cooper

(57) ABSTRACT

A magazine assembly includes a magazine body, a follower disposed at least partially within the magazine body, a spring disposed within the magazine body, a floorplate disposed at a lower end of the spring, and a baseplate attached to a lower end of the magazine body. The magazine body includes an internal cavity for holding at least one cartridge such that a front to rear length of the internal cavity is approximately half of an overall front to rear length of the magazine body.

20 Claims, 23 Drawing Sheets

(56) References Cited

U.S. PATENT DOCUMENTS

| | | | | |
|---|---|---|---|---|
| 8,069,601 | B1 | 12/2011 | Fitzpatrick et al. | |
| 8,166,692 | B2 | 5/2012 | Fitzpatrick et al. | |
| 8,196,327 | B2 | 6/2012 | Rich | |
| 8,635,796 | B2 | 1/2014 | Fitzpatrick et al. | |
| 8,689,475 | B2 | 4/2014 | Battaglia | |
| 8,839,543 | B2 | 9/2014 | Fitzpatrick et al. | |
| 8,887,428 | B1 | 11/2014 | Lemoine | |
| 8,991,086 | B2 | 3/2015 | Fitzpatrick et al. | |
| 9,194,635 | B1 * | 11/2015 | Gibbens | F41A 3/12 |
| 9,347,720 | B2 | 5/2016 | Fitzpatrick et al. | |
| 9,347,721 | B2 | 5/2016 | Larson, Jr. | |
| 9,523,546 | B1 | 12/2016 | Harding | |
| 9,746,264 | B2 | 8/2017 | Fitzpatrick et al. | |
| 9,772,151 | B1 | 9/2017 | Sanderson et al. | |
| 9,784,512 | B1 | 10/2017 | Harding | |
| 9,945,627 | B2 | 4/2018 | Porat | |
| 10,048,030 | B2 | 8/2018 | Corso | |
| 10,066,886 | B2 | 9/2018 | Vilardi et al. | |
| 10,072,903 | B2 | 9/2018 | Fitzpatrick et al. | |
| 10,190,835 | B2 | 1/2019 | Hsu et al. | |
| 10,222,153 | B1 | 3/2019 | Harding | |
| 10,254,063 | B2 | 4/2019 | Duhon | |
| 10,260,827 | B2 * | 4/2019 | Mock | F41A 11/02 |
| 10,393,457 | B2 | 8/2019 | Fitzpatrick et al. | |
| 10,598,454 | B2 * | 3/2020 | DiChario | F41A 33/00 |
| 10,809,028 | B2 | 10/2020 | Underwood et al. | |
| 10,996,010 | B2 | 5/2021 | Cass | |
| 11,054,202 | B1 | 7/2021 | Underwood et al. | |
| 11,131,517 | B2 | 9/2021 | Coggins | |
| 11,193,725 | B2 | 12/2021 | Lee et al. | |
| 11,204,212 | B2 | 12/2021 | Lee | |
| RE49,104 | E | 6/2022 | Fitzpatrick et al. | |
| 11,408,697 | B2 | 8/2022 | Szczepkowski et al. | |
| 11,530,888 | B2 | 12/2022 | Underwood et al. | |
| 11,573,060 | B2 | 2/2023 | Shreve | |
| 2007/0199435 | A1 | 8/2007 | Hochstrate et al. | |
| 2010/0126053 | A1 | 5/2010 | Fitzpatrick et al. | |
| 2011/0113663 | A1 | 5/2011 | Nakayama et al. | |
| 2013/0086834 | A1 | 4/2013 | Battaglia | |
| 2013/0247437 | A1 | 9/2013 | Obermeit | |
| 2014/0373416 | A1 | 12/2014 | Barnhart | |
| 2015/0068089 | A1 | 3/2015 | Mock et al. | |
| 2015/0241162 | A1 | 8/2015 | Geraghty et al. | |
| 2016/0282071 | A1 | 9/2016 | Vilardi et al. | |
| 2016/0348992 | A1 | 12/2016 | Tisone et al. | |
| 2017/0138685 | A1 * | 5/2017 | Beasley | F41A 9/71 |
| 2017/0307319 | A1 | 10/2017 | Jarboe | |
| 2018/0180371 | A1 * | 6/2018 | Beasley | F41A 9/71 |
| 2019/0226779 | A1 * | 7/2019 | DiChario | F41A 9/71 |
| 2019/0331444 | A1 * | 10/2019 | Underwood | F41A 9/71 |
| 2019/0353441 | A1 | 11/2019 | Underwood et al. | |
| 2021/0207905 | A1 * | 7/2021 | Underwood | F41A 9/70 |
| 2021/0302114 | A1 | 9/2021 | Underwood et al. | |
| 2021/0389068 | A1 * | 12/2021 | Philbin | F41A 17/38 |
| 2022/0252365 | A1 * | 8/2022 | Philbin | F41A 17/36 |
| 2022/0357121 | A1 | 11/2022 | Binder et al. | |
| 2022/0364809 | A1 * | 11/2022 | Overstreet | F41A 9/70 |
| 2022/0390203 | A1 | 12/2022 | Keng | |
| 2023/0168053 | A1 | 6/2023 | Underwood et al. | |

* cited by examiner

FIREARM MAGAZINE ASSEMBLIES

CROSS REFERENCE TO RELATED APPLICATION

This application is related to and claims priority benefit from U.S. Provisional Application No. 63/614,003 ("the '003 application"), filed on Dec. 22, 2023. The '003 application is hereby incorporated in its entirety by this reference.

FIELD OF THE INVENTION

The field of the invention relates to magazine assemblies for firearms, particularly magazine systems designed for alternative caliber ammunition.

BACKGROUND

Since the advent and standardization of self-contained metallic cartridge ammunition, firearms have included systems and devices for loading and/or storing ammunition. Many modern firearms (including handguns, rifles, carbines, shotguns, etc.) include a magazine for storing and/or feeding ammunition. Magazines may be integral/fixed to the firearm or may be detachable. Different magazine arrangements include tube, box, rotary, drum, casket, pan, helical, saddle-drum, or various other arrangements.

In some cases, particular firearm designs may be adapted to function with various calibers. For example, the popularity of AR-15 variant (civilian) or M16/M4 (military) firearm platform (i.e., collectively AR-15 style firearms) has inspired numerous variations for different calibers. Traditional box magazines for AR-15 style firearms are often limited to thirty or forty rounds (i.e., standard capacity magazines). Most typical AR-15 firearms are chambered for 5.56×45 mm NATO and/or 0.223 Remington. Many receivers and/or magazines may be modified to operate with 300 BLK (7.62×35 mm). However, conventional designs intended to use other calibers require a different receiver, modification to the receiver, and/or a different magazine. Accordingly, it may be desirable to design a magazine assembly for alternative calibers such that a conventional receiver can be used with alternative caliber ammunition.

To increase capacity, adaptability, functionality, and ergonomics, it may be desirable to design new magazine assemblies designed for different calibers.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, a magazine assembly comprises: a magazine body; a follower disposed at least partially within the magazine body; a spring disposed within the magazine body; a floorplate disposed at a lower end of the spring; and a baseplate attached to a lower end of the magazine body, wherein the magazine body comprises an internal cavity for holding at least one cartridge such that a front to rear length of the internal cavity is approximately half of an overall front to rear length of the magazine body.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-16 illustrate components of various semi-automatic or automatic firearms, the features, concepts, and functions described herein are also applicable (with potential necessary alterations for particular applications) to handguns, rifles, carbines, pistols, shotguns, or any other type of firearm.

Figure 9A:
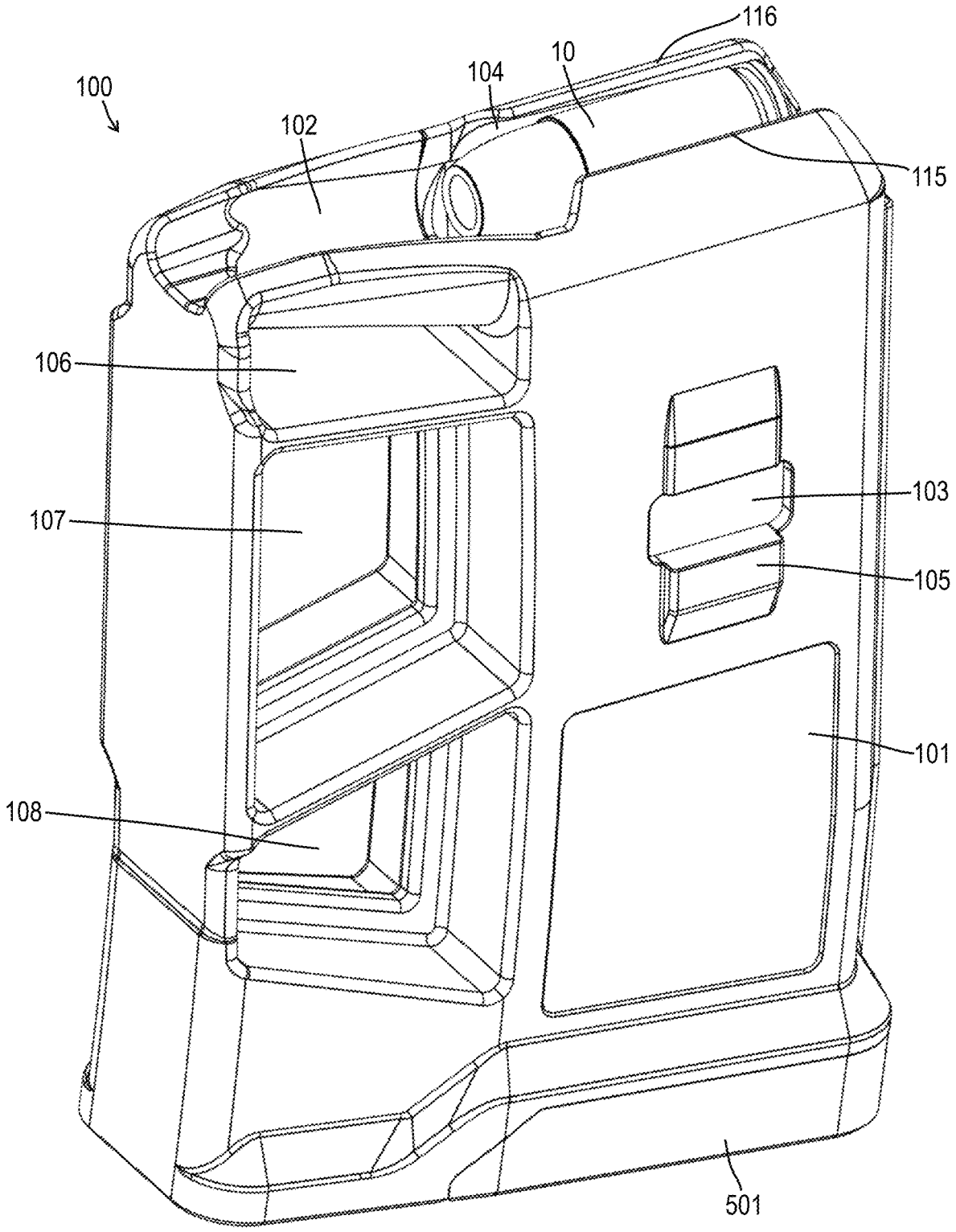
FIG. 9A is a front left perspective view of a magazine assembly according to certain embodiments of the present invention.
Figure 9B:
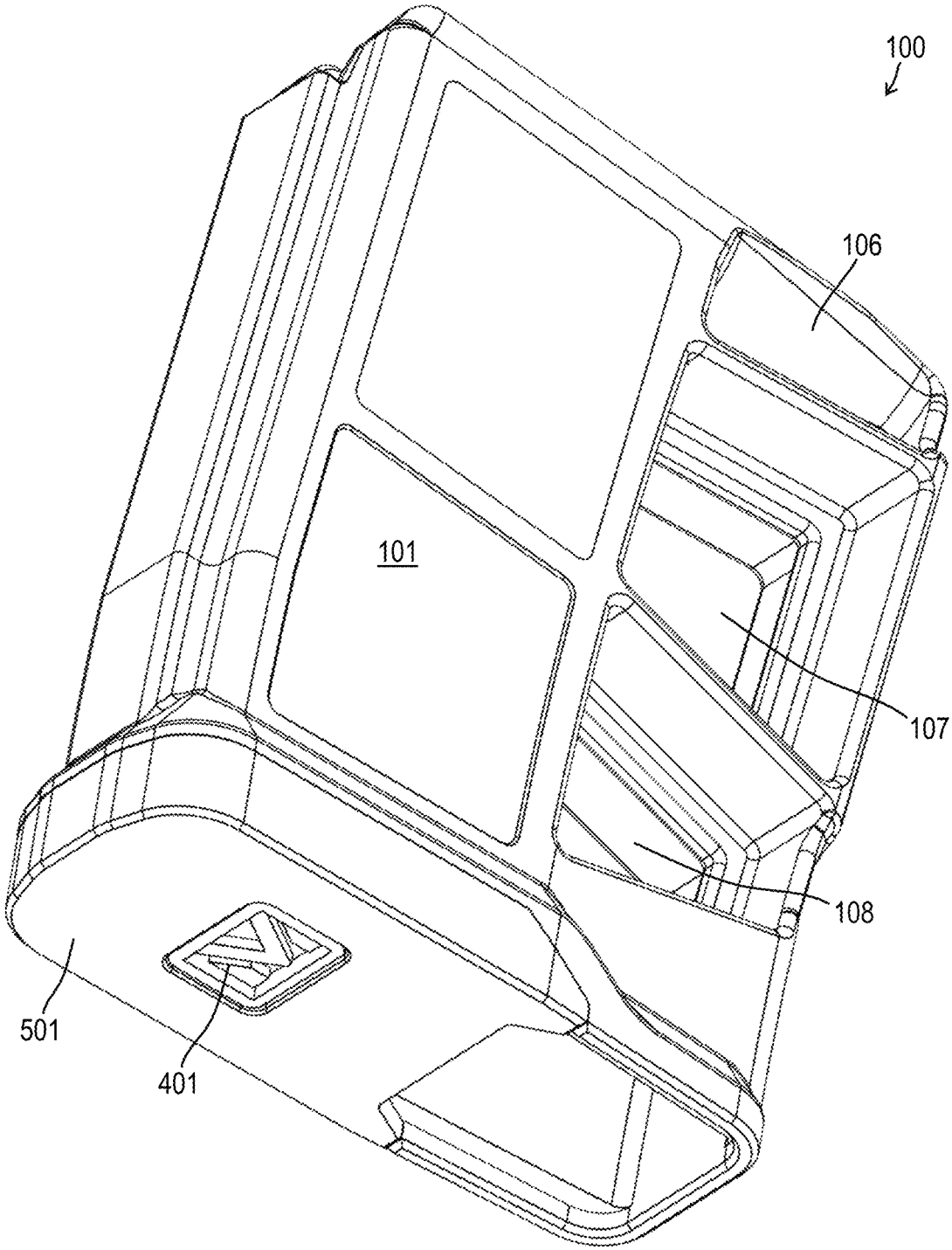
FIG. 9B is a rear right perspective view of the magazine assembly of FIG. 9A.
Figure 10:
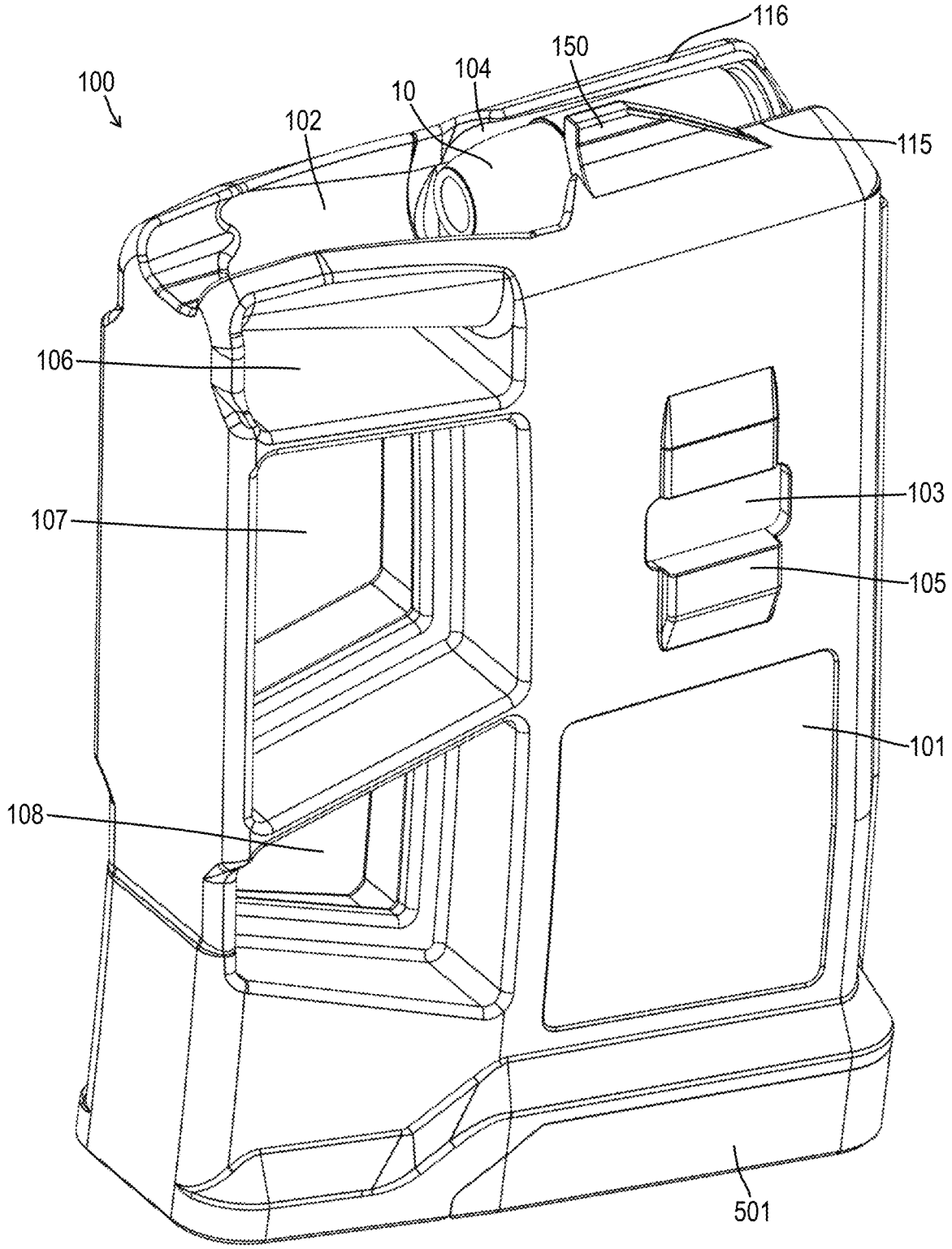
FIG. 10 is a front left perspective view of a magazine assembly with an ejector according to certain embodiments of the present invention.
Figure 11A:
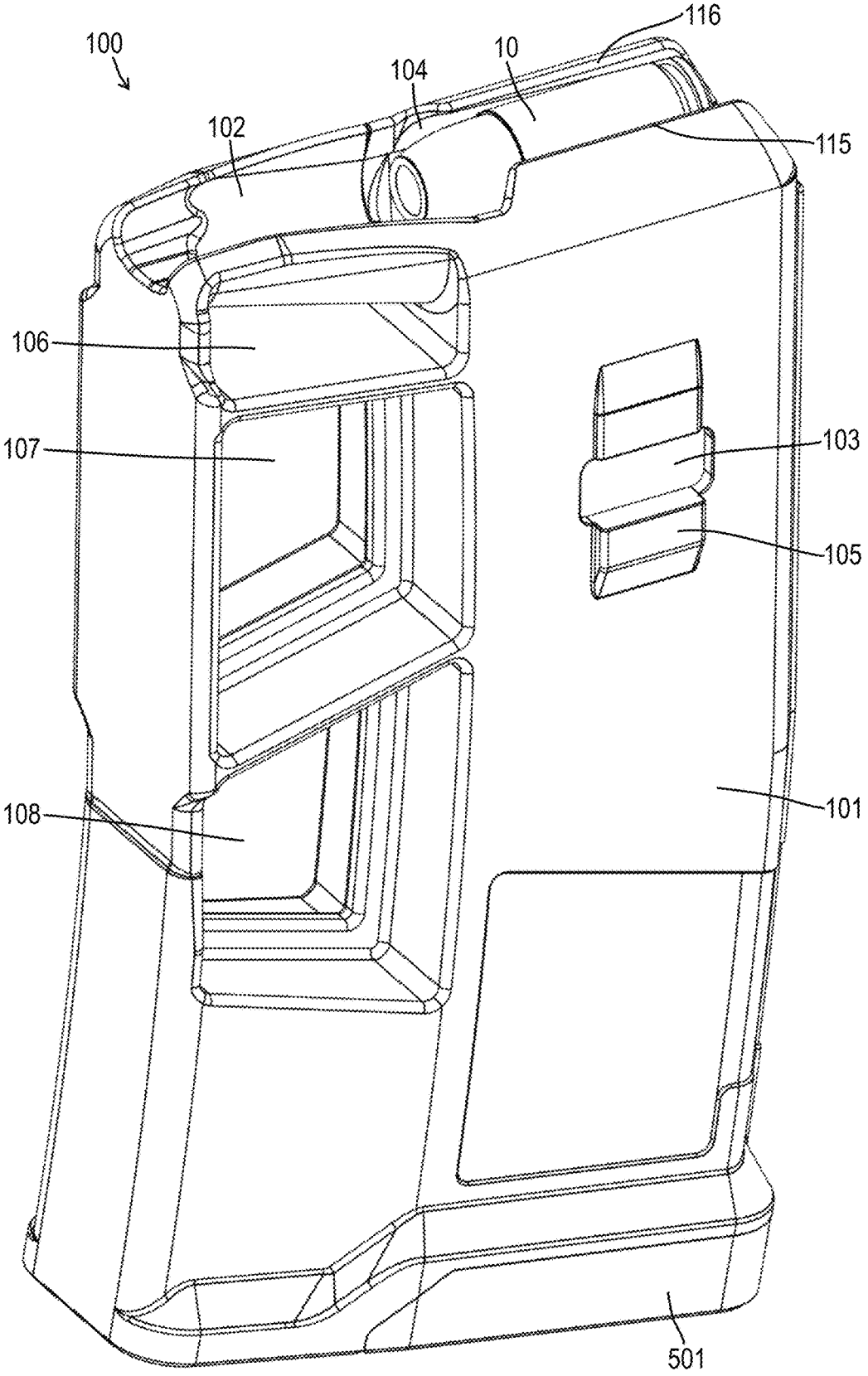
FIG. 11A is a front left perspective view of a magazine assembly according to certain embodiments of the present invention.
Figure 11B:
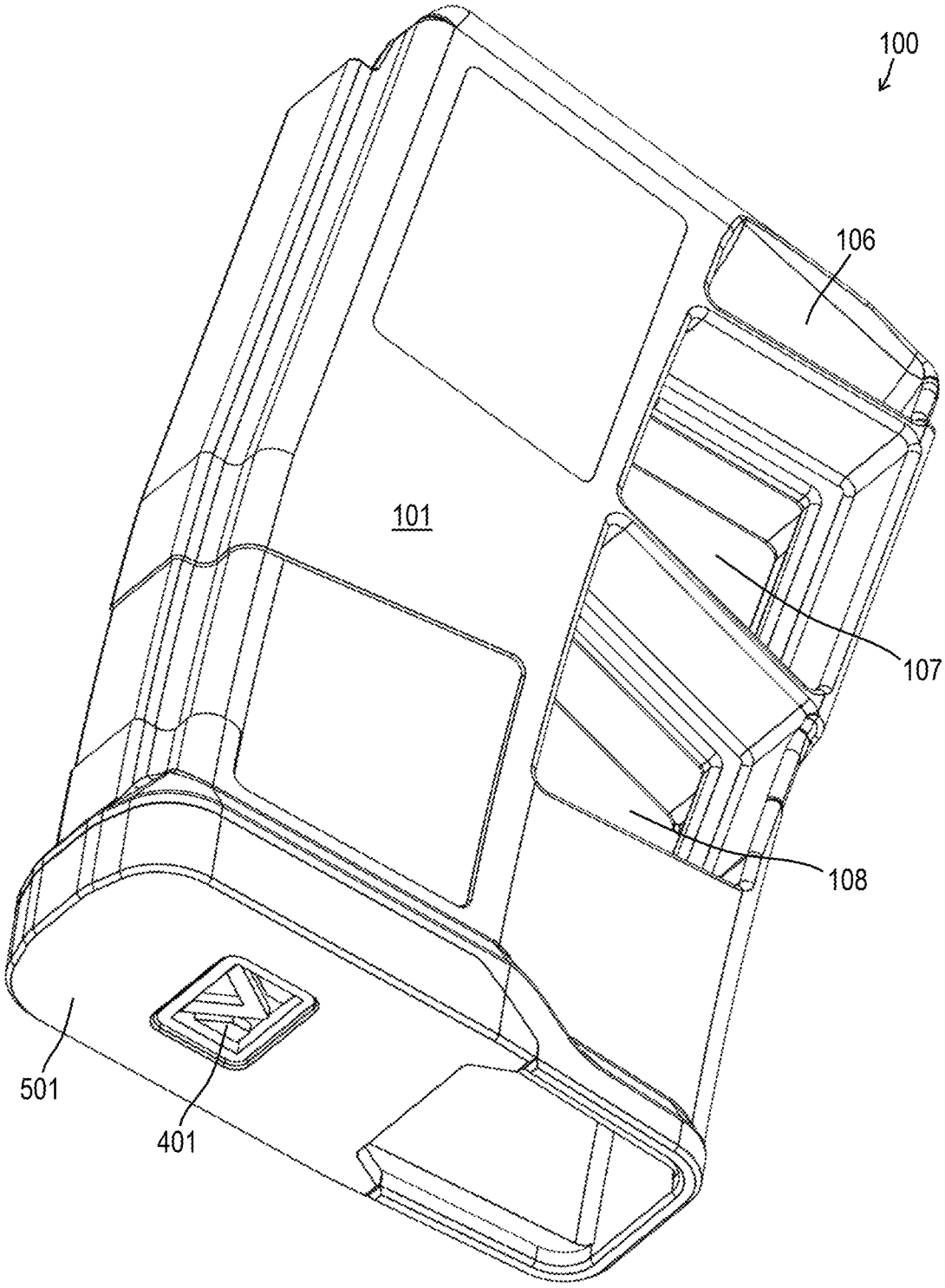
FIG. 11B is a rear right perspective view of the magazine assembly of FIG. 11A.
Figure 12:
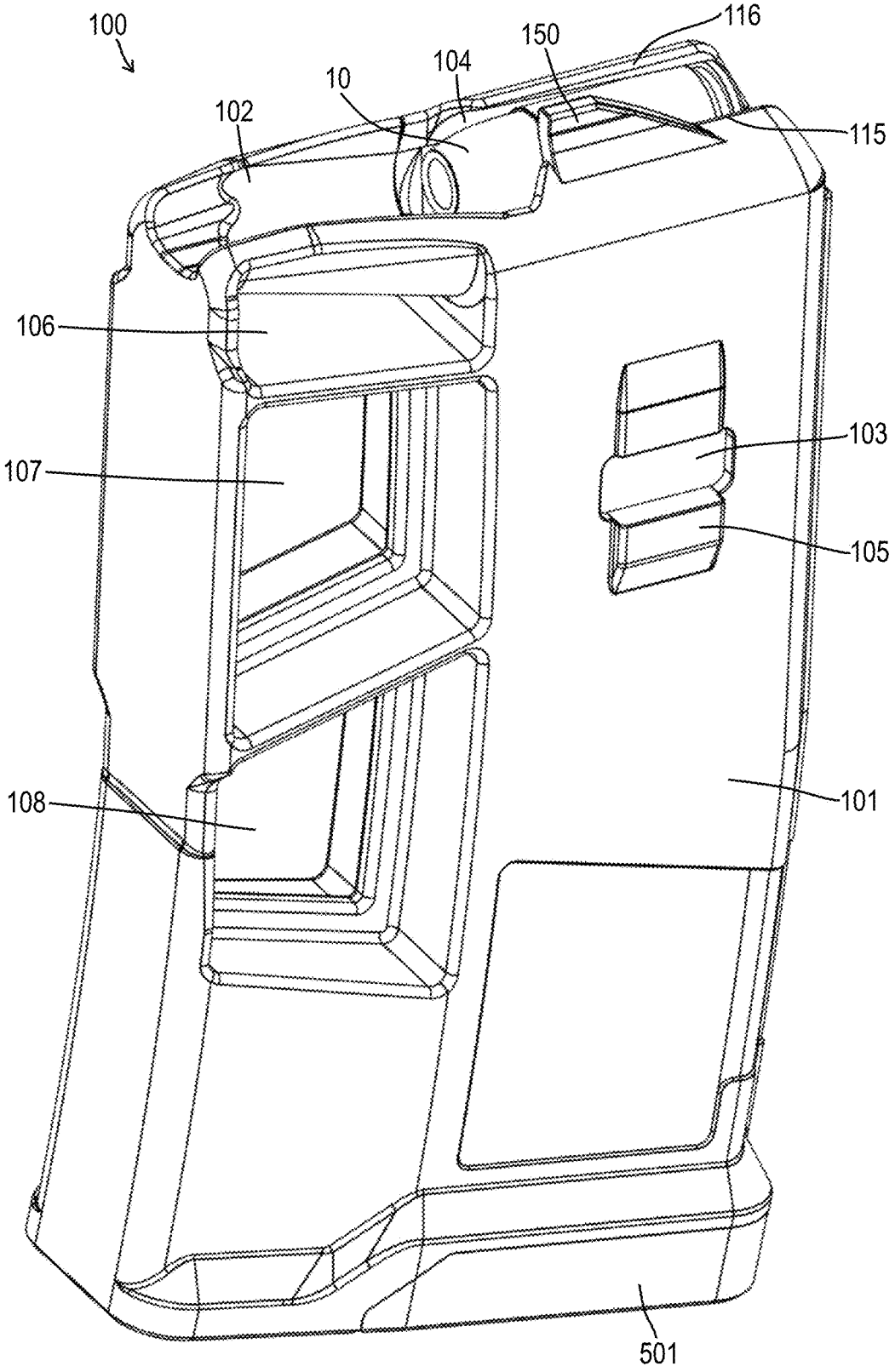
FIG. 12 is a front left perspective view of a magazine assembly with an ejector according to certain embodiments of the present invention.
Figure 13A:
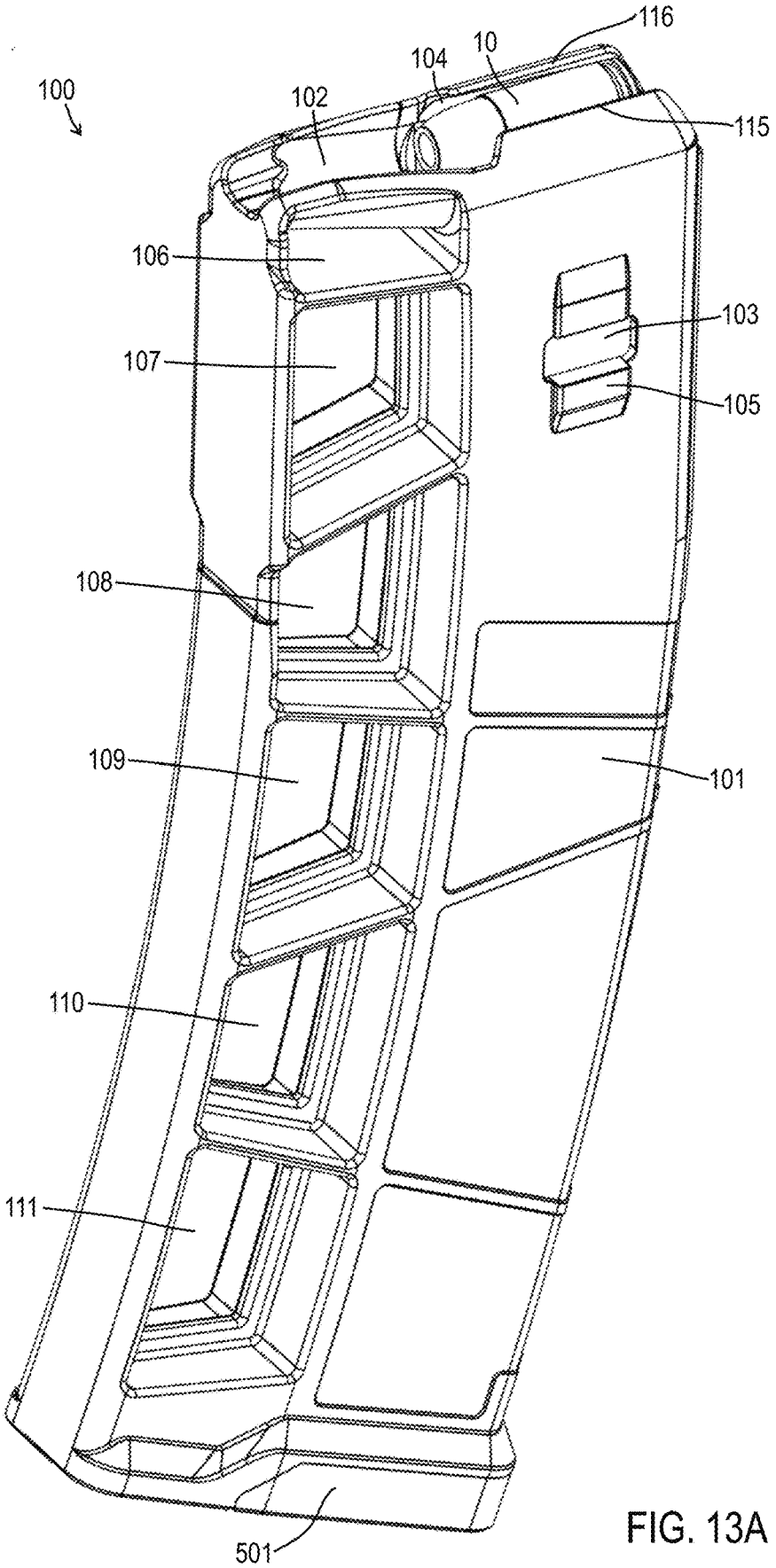
FIG. 13A is a front left perspective view of a magazine assembly according to certain embodiments of the present invention.
Figure 13B:
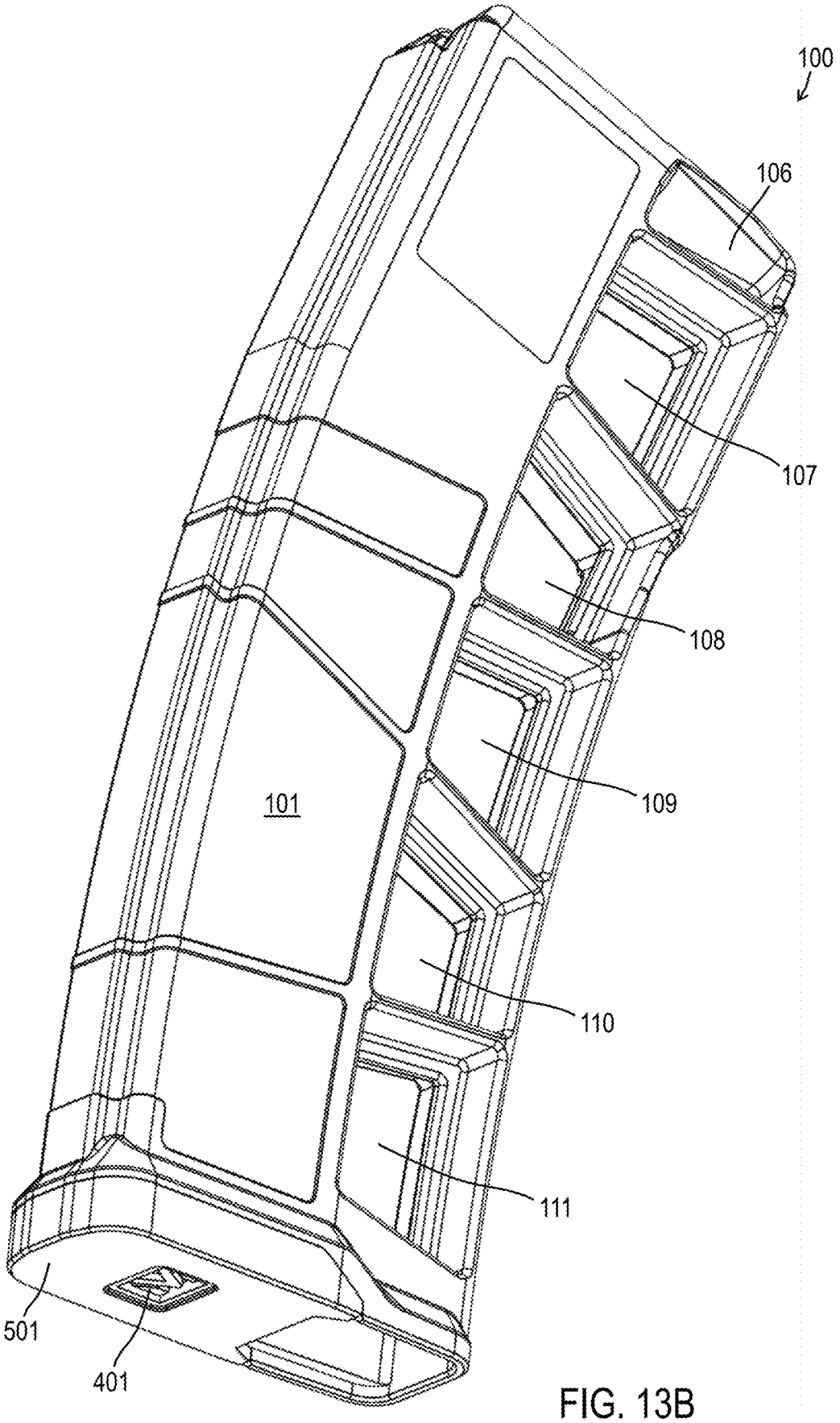
FIG. 13B is a rear right perspective view of the magazine assembly of FIG. 13A.
Figure 14:
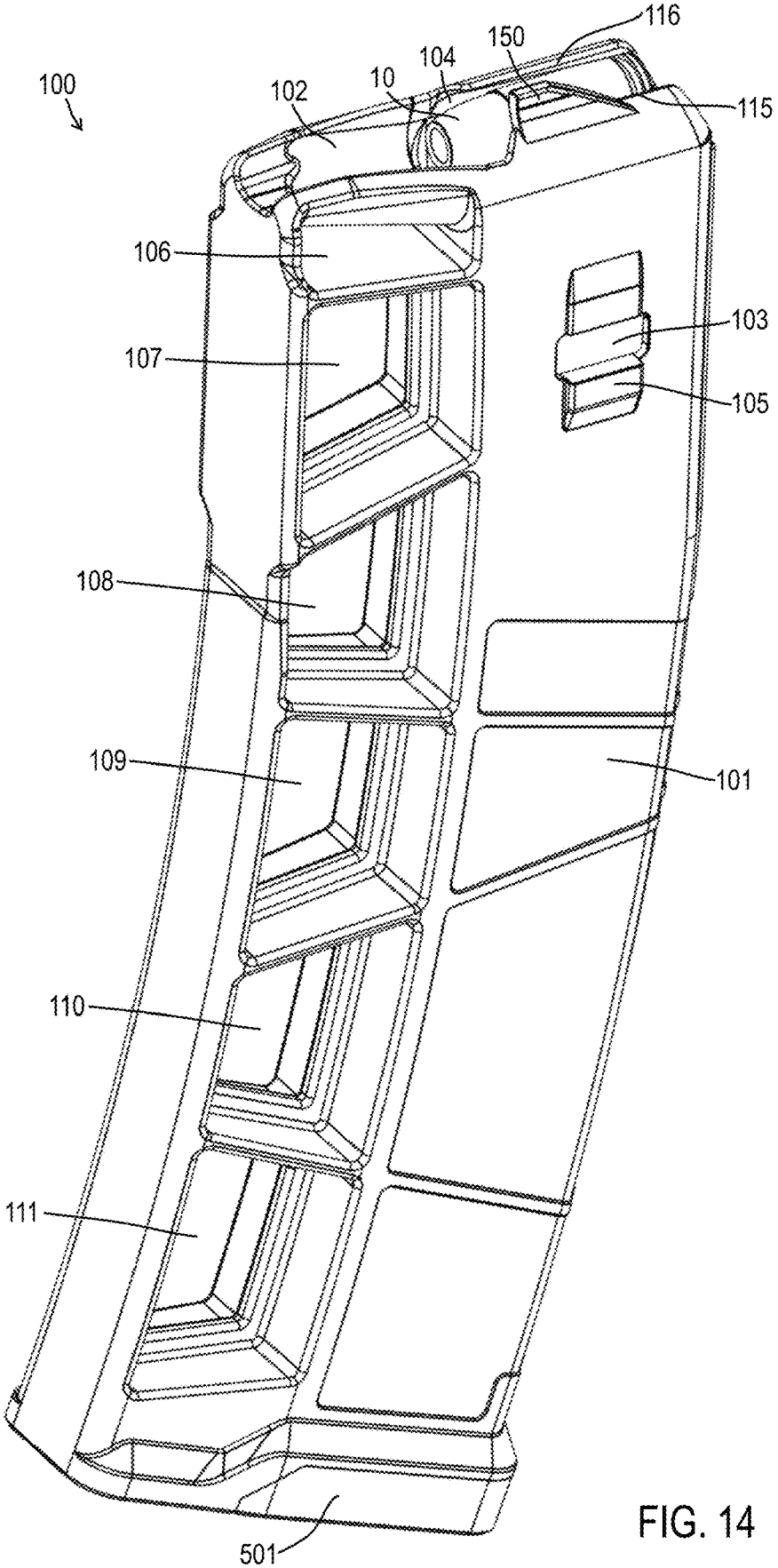
FIG. 14 is a front left perspective view of a magazine assembly with an ejector according to certain embodiments of the present invention.
Figure 15A:
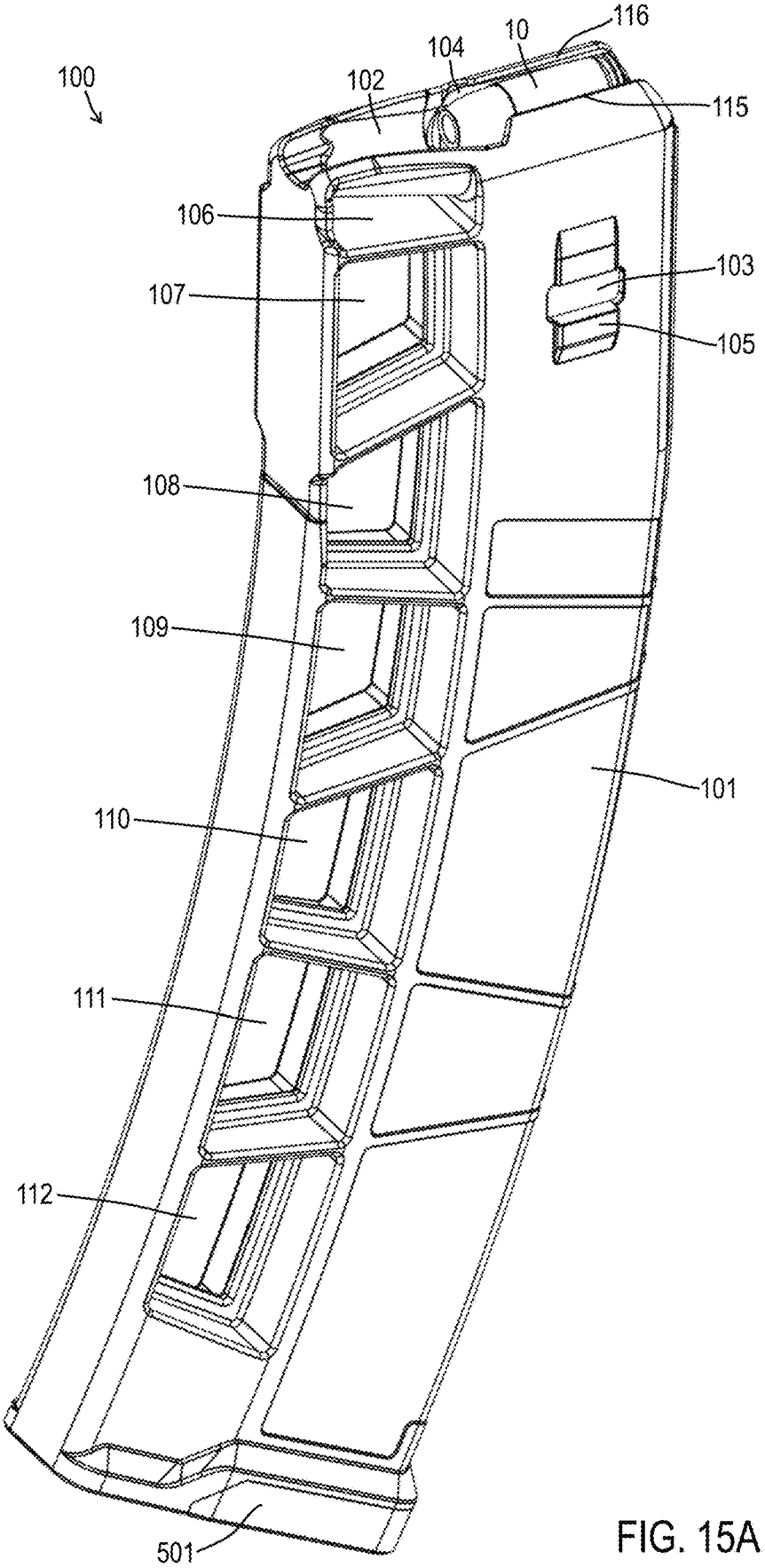
FIG. 15A is a front left perspective view of a magazine assembly according to certain embodiments of the present invention.
Figure 15B:
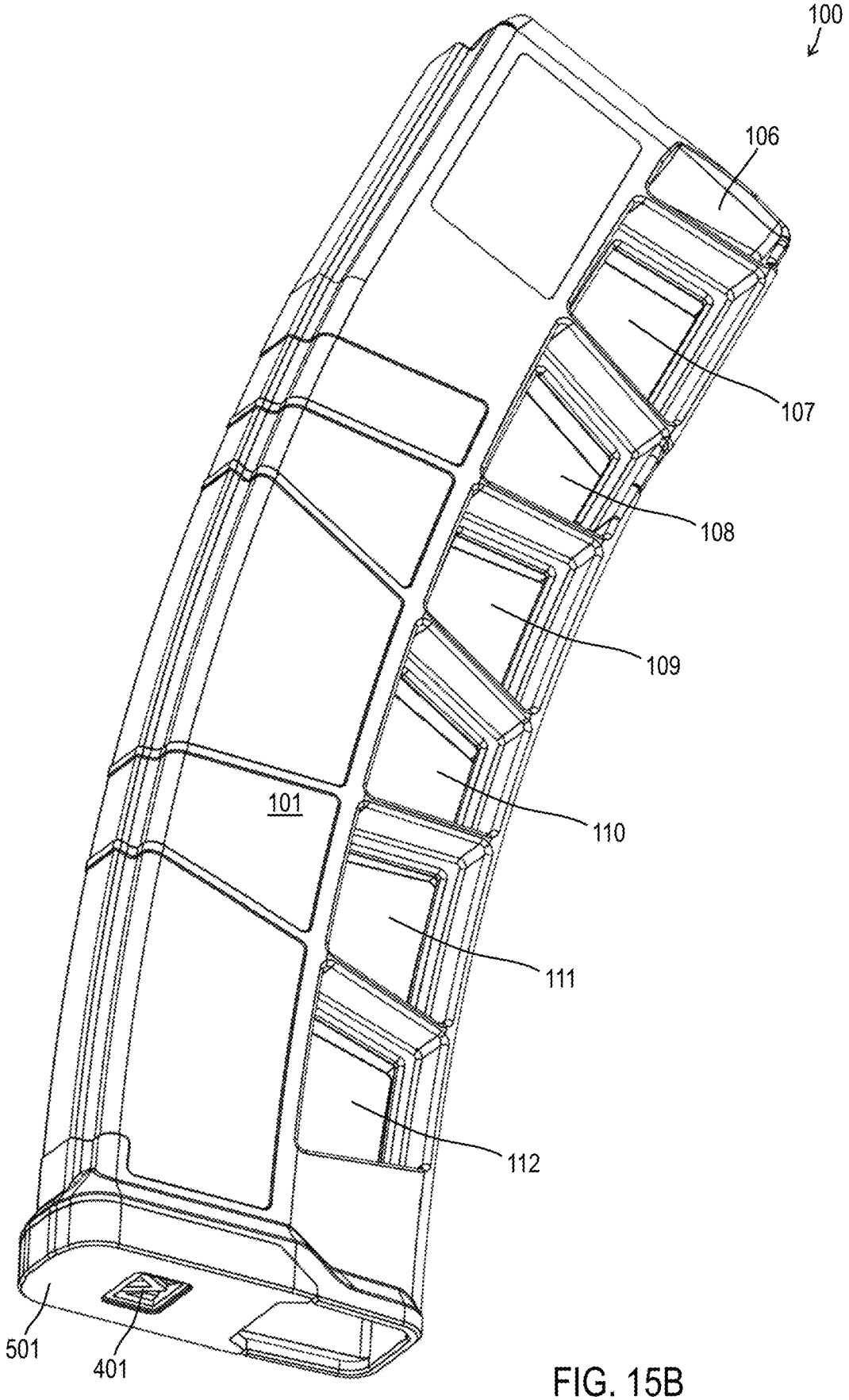
FIG. 15B is a rear right perspective view of the magazine assembly of FIG. 15A.
Figure 16:
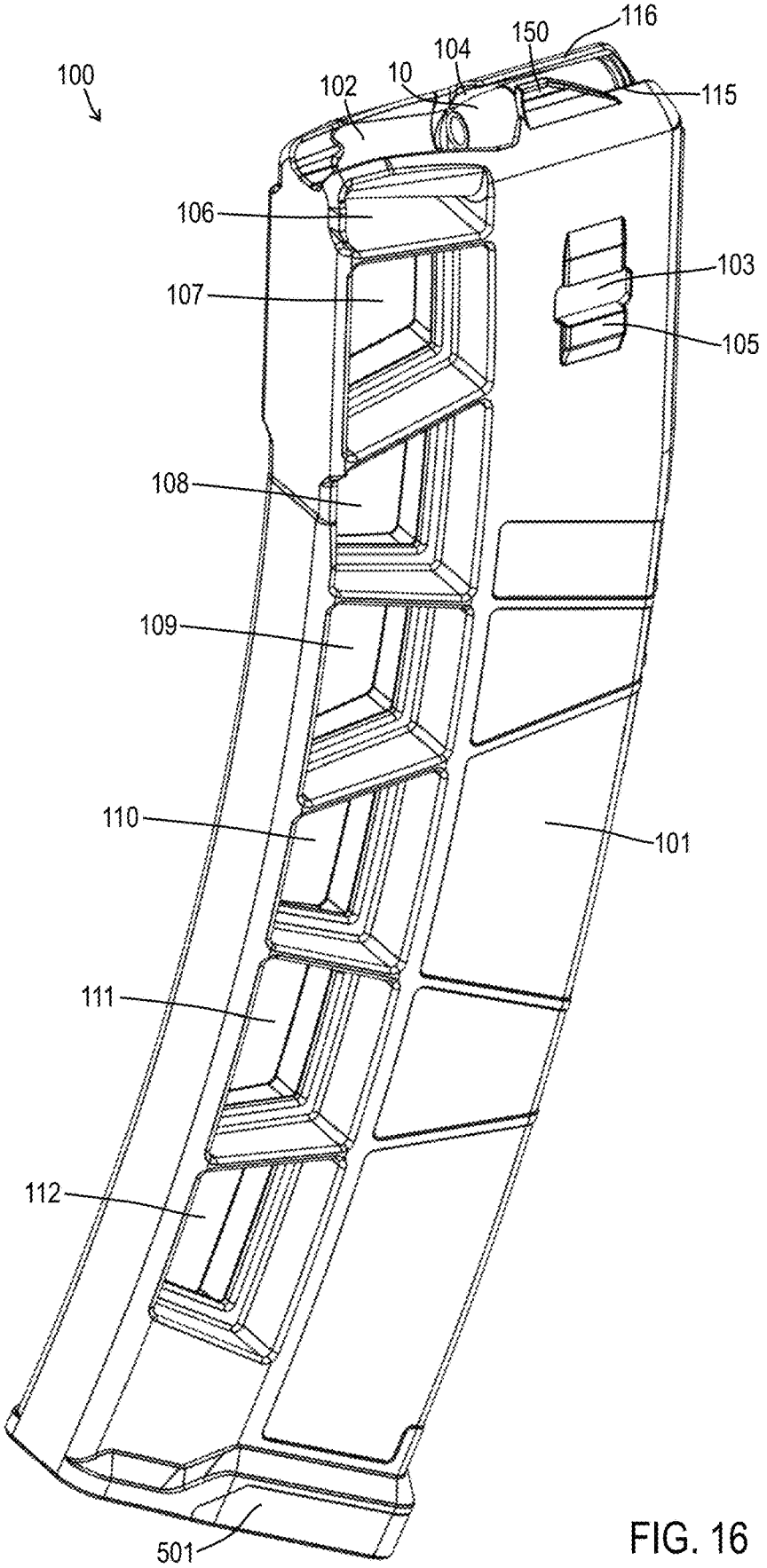
FIG. 16 is a front left perspective view of a magazine assembly with an ejector according to certain embodiments of the present invention.

In some embodiments, a magazine assembly 100 may attach to or be inserted into a firearm. For example, the magazine assembly 100 may be inserted into a firearm receiver. In some embodiments, the magazine assembly 100 includes a magazine body 101, a follower 201, a spring 301, a floorplate 401, and a baseplate 501 (see, e.g., FIG. 3). The magazine assembly 100 may have a capacity of 10 rounds, 11 rounds, 12 rounds, 13 rounds, 14 rounds, 15 rounds, 16 rounds, 17 rounds, 18 rounds, 19 rounds, 20 rounds, 21 rounds, 22 rounds, 23 rounds, 24 rounds, 25 rounds, 26 rounds, 27 rounds, 28 rounds, 29 rounds, 30 rounds, 31 rounds, 32 rounds, 33 rounds, 34 rounds, 35 rounds, 36 rounds, 37 rounds, 38 rounds, 39 rounds, 40 rounds, 45 rounds, 50 rounds, 100 rounds, and/or any other appropriate capacity. As shown in the drawings, the magazine body 101 and the spring 301 may have multiple configurations and/or lengths designed for different ammunition capacities. For example, exemplary small capacity configurations of the magazine assembly 100 are shown in FIGS. 9A-10. These small capacity configurations may be capable of holding 8, 9, 10, 11, 12, or any other appropriate number of rounds. Exemplary small capacity configurations of the magazine assembly 100 are shown in FIGS. 11A-12. These small capacity configurations may be capable of holding 13, 14, 15, 16, 17, or any other appropriate number of rounds. Exemplary small capacity configurations of the magazine assembly 100 are shown in FIGS. 1A, 1B, 3, and 8A. These small capacity configurations may be capable of holding 18, 19, 20, 21, 22, or any other appropriate number of rounds. Exemplary standard capacity configurations of the magazine assembly 100 are shown in FIGS. 13A-14. These standard capacity configurations may be capable of holding 30, 31, 32, 33, 34, or any other appropriate number of rounds. Exemplary standard capacity configurations of the magazine assembly 100 are shown in FIGS. 15A-16. These standard capacity configurations may be capable of holding 38, 39, 40, 41, 42, or any other appropriate number of rounds.

In some examples, the magazine body 101 is compatible with accessories, receptacles, and/or systems designed for conventional magazines and/or various commercially available magazines, such as a Standardization Agreement (STANAG) magazine, designed for 5.56×45 mm NATO ammunition and/or functions as a new magazine with a similar form factor such that the new magazine is compatible with firearms designed for such conventional magazines. The magazine assembly 100 may be configured to be inserted into a U.S. military specification (milspec) lower receiver for an AR-15 variant (civilian) or M16/M4 (military) firearm (i.e., collectively AR-15 style firearms). In some embodiments, the magazine assembly 100 may be compatible with various calibers including rifle calibers such as, for example, 5.56×45 mm NATO, 0.223 Remington, 300 BLK (7.62×35 mm), 7.62×51 mm NATO, 0.308 Winchester, 7.62×39 mm, 5.45×39 mm; pistol calibers such as, for example, 9×19 mm, 0.45 ACP, 0.40 S&W, 0.380 ACP, 0.38 ACP, 0.38 Super, 0.22 Long Rifle, 10 mm Auto, 5.7×28 mm; and shotgun calibers such as, for example, 12 gauge, 20 gauge, 28 gauge, 0.410 gauge, 10 gauge, 16 gauge.

As shown in FIGS. 1A, 3, 7A-8A, 9A, 10, 11A, 12, 13A, 14, 15A, and 16, the magazine body 101 may include features for securing the magazine assembly 100 relative to a firearm. For example, the magazine body 101 may be designed such that the magazine catch cavity 103 interfaces with a magazine catch feature of a firearm receiver. In some cases, the magazine catch protrusion 105 prevents the magazine assembly 100 from moving too far upward relative to the firearm receiver.

The magazine body 101 may include a feed ramp 102, a magazine catch cavity 103, an internal cavity 104, a magazine catch protrusion 105, at least one aperture 106-112, at least one feed lip 115, 116, an ejector 150, and/or any other appropriate feature. The magazine body 101 may be designed such that the follower 201, the spring 301, and the cartridge(s) 10 are located and move within the internal cavity 104. The internal cavity 104 may be enclosed with structural surfaces of the magazine body 101 on the forward side, the rear side, the left side, and the right side. The bottom side of the internal cavity 104 may be enclosed with the baseplate 501. The upper side of the internal cavity 104 may be partially enclosed with the at least one feed lip 115, 116. The at least one feed lip 115, 116 may prevent the follower 201 from exiting through the upper side of the internal cavity 104. The at least one feed lip 115, 116 may also function to hold the uppermost cartridge 10 in a feeding position such that the mechanism of a firearm (i.e., a bolt or bolt carrier group) can remove the cartridge 10 from the magazine assembly 100. In some embodiments, the front to rear length of the internal cavity 104 (e.g., see dimension X in FIG. 7B) is approximately half of the overall length of the magazine body 101 (e.g., see dimension Y in FIG. 7B). In some embodiments, the front to rear length of the internal cavity 104 (e.g., see dimension X in FIG. 7B) is at least one third of the overall length of the magazine body 101 (e.g., see dimension Y in FIG. 7B).

In some embodiments, at the upper portion, the magazine body 101 may be designed such that the feed ramp 102 is disposed on the forward half extending from the forward end of the internal cavity 104 to the forwardmost portion of the magazine body 101. As shown in FIGS. 2A, 2B, 7A, 7B, and 8B, the feed ramp 102 may include a forward portion 102*a*, a central portion 102*b*, and a rear portion 102*c*. The rear portion 102*c* may include an approximately triangular shaped protrusion that engages a corresponding notch 208 of the follower 201 (see FIG. 4A). In some cases, the majority of the feed ramp 102 may include the central portion 102*b*, which has a curved and/or an approximate conical (or partially conical) shape that tilts upward toward a forward end of the magazine body 101. The forward portion 102*a* may extend from the forwardmost portion of the central portion 102*b* to the forward end of the magazine body 101. In some embodiments, the forward portion 102*a* has a curved and/or an approximate cylindrical shape.

As shown in the drawings, the magazine body 101 may include at least one aperture 106-112 on a forward side of the internal cavity 104. The magazine body 101 may include an upper aperture 106 below the feed ramp 102. In some embodiments, the upper aperture 106 an upper surface that approximately matches the shape of the central portion 102*b* of the feed ramp 102. The lower surface of the upper aperture 106 may be approximately planar. In some embodiments, the lower surface of the upper aperture 106 may be oblique relative to the vertical axis of the magazine and/or may be oblique relative to the forward surface 104*a* of the internal cavity 104. The next aperture below the upper aperture 106 may be aperture 107. The overall profile/shape of the aperture 107 may be a quadrilateral. In some cases, at least one edge of aperture 107 may be a curve (not a straight line). For example, the edge adjacent to the internal cavity 104 may be a curve.

In some embodiments, the size of the various aperture(s) 106-112 are consistent among the various capacity configurations. For example, the upper aperture 106 may be the same size for all configurations. Similarly, the aperture 107 may be the same size for all configurations. The aperture 108 may be different for the small capacity configurations of the magazine assembly 100 illustrated in FIGS. 9A-10, but the aperture 108 may be the same size for all other configurations. The aperture 109 may be the same size for all configurations that include this aperture. The aperture 110 may be the same size for all configurations that include this aperture. The aperture 111 may be the same size for all configurations that include this aperture. The aperture 112 may be the same size for all configurations that include this aperture. It is noted that only one illustrated configuration includes aperture 112 but other embodiments may include this feature and/or additional apertures. In some embodiments, aperture(s) 107-112 are designed using a single shape while in other embodiments there are two distinct shapes for the apertures. For example, in some cases, apertures 107, 109, and 111 have the same shape while apertures 108, 110, and 112 have the same shape. As described above, aperture 108 may be different for the small capacity configurations of the magazine assembly 100 illustrated in FIGS. 9A-10.

The aperture(s) 106-112 may be designed to reduce the material necessary for the magazine body 101 which reduces weight, material, and cost along with various other advantages. These features may lead to benefits related to manufacturing, cost, weight, shipping, logistics, etc. As another example, the truss structure created by the edges of the apertures results in a structurally efficient construction for the magazine body 101 such that the magazine assembly 100 can absorb and withstand significant forces and impacts, including forces or impacts that would break other magazines. In addition, the aperture(s) 106-112 may be designed such that an operator can insert his or her finger(s) through the various apertures to improve grip and secure handling of the magazine assembly 100. The design of the aperture(s) 106-112 may also affect the aesthetic appearance of the magazine assembly 100. In some embodiments, at least some of the aperture(s) 106-112 are designed to receive an insert, plug, or other accessory designed to removably attach to the magazine assembly 100. The modular insert(s) may fill one or more of the aperture(s) 106-112 to cover one side or may extend to block both sides of the aperture(s) 106-112. The insert(s) may be for aesthetic purposes (color, pattern, contrasting color, etc.), may be used to provide identifying information for the magazine assembly 100 (caliber, ammunition type, etc.), may enhance grip (texture, stippling, rubberized polymer material, etc.), may provide additional weight/ballast, may augment the structural properties of the magazine assembly 100, and/or any other appropriate purpose.

The follower 201 is shown in FIGS. 2A-4B, 7A, and 7B. In some embodiments, the follower 201 includes a forward skirt 211, a rear skirt 212, a notch 208, a protrusion 209, and at least one engagement feature 217, 218. As discussed above in the context of the feed ramp 102, the notch 208 may interface with a feature of the rear portion 102*c* of the feed ramp 102. The protrusion of the rear portion 102*c* and this interface may function to guide cartridges 10 from the follower 201 onto the feed ramp 102. In some cases, the protrusion of the rear portion 102*c* may help prevent the rim of the cartridge 10 from catching on the trailing edge of the feed ramp 102. The protrusion 209 may be designed to engage a bolt catch feature of a firearm receiver. For example, the protrusion 209 may actuate a bolt catch after the last round of a magazine is fired to engage a last round bolt hold open feature of the firearm. The at least one engagement feature 217, 218 may be designed to removably attach the follower 201 to the upper end of the spring 301.

Figure 1A:
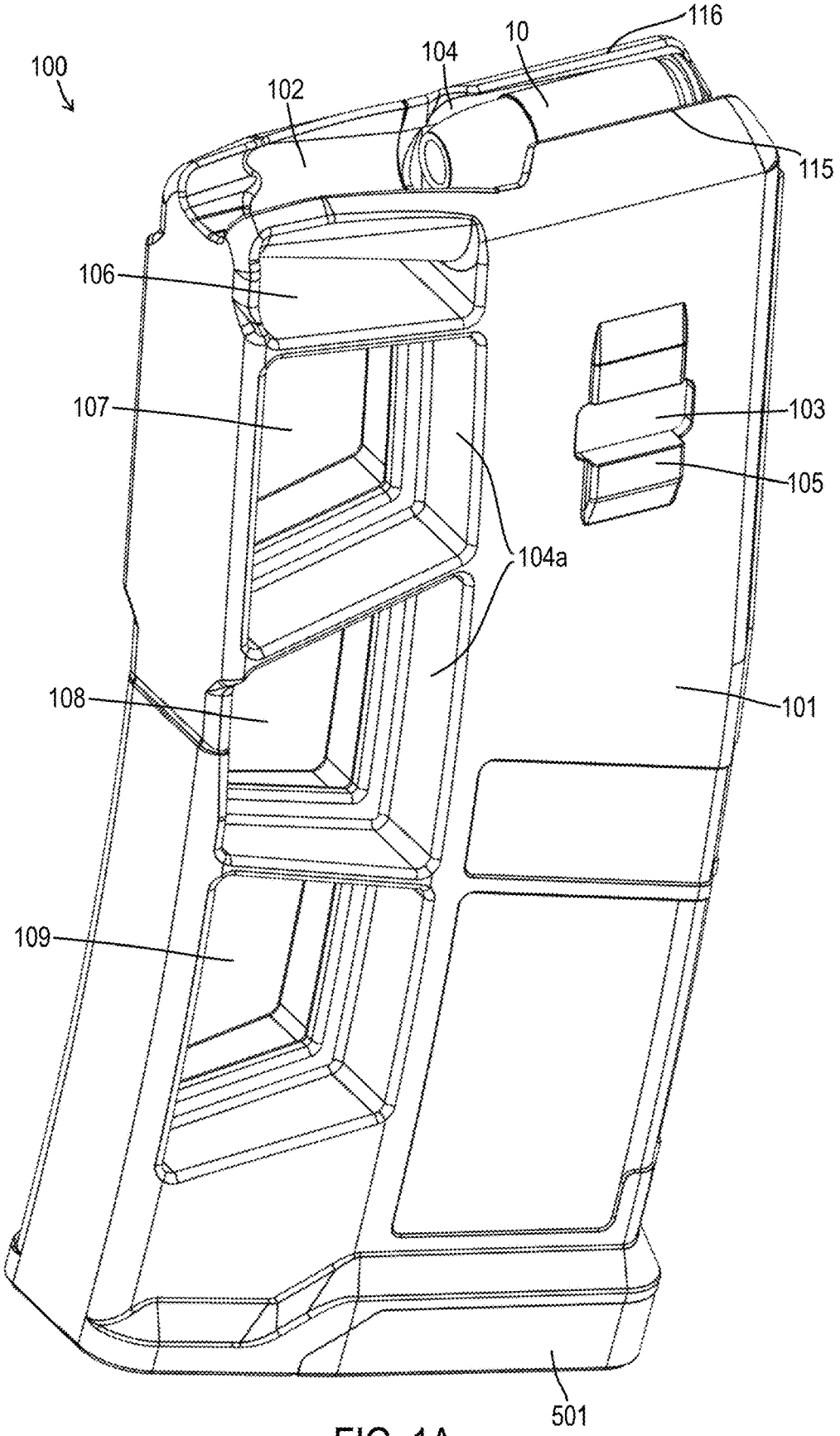
FIG. 1A is a front left perspective view of a magazine assembly according to certain embodiments of the present invention.
Figure 1B:
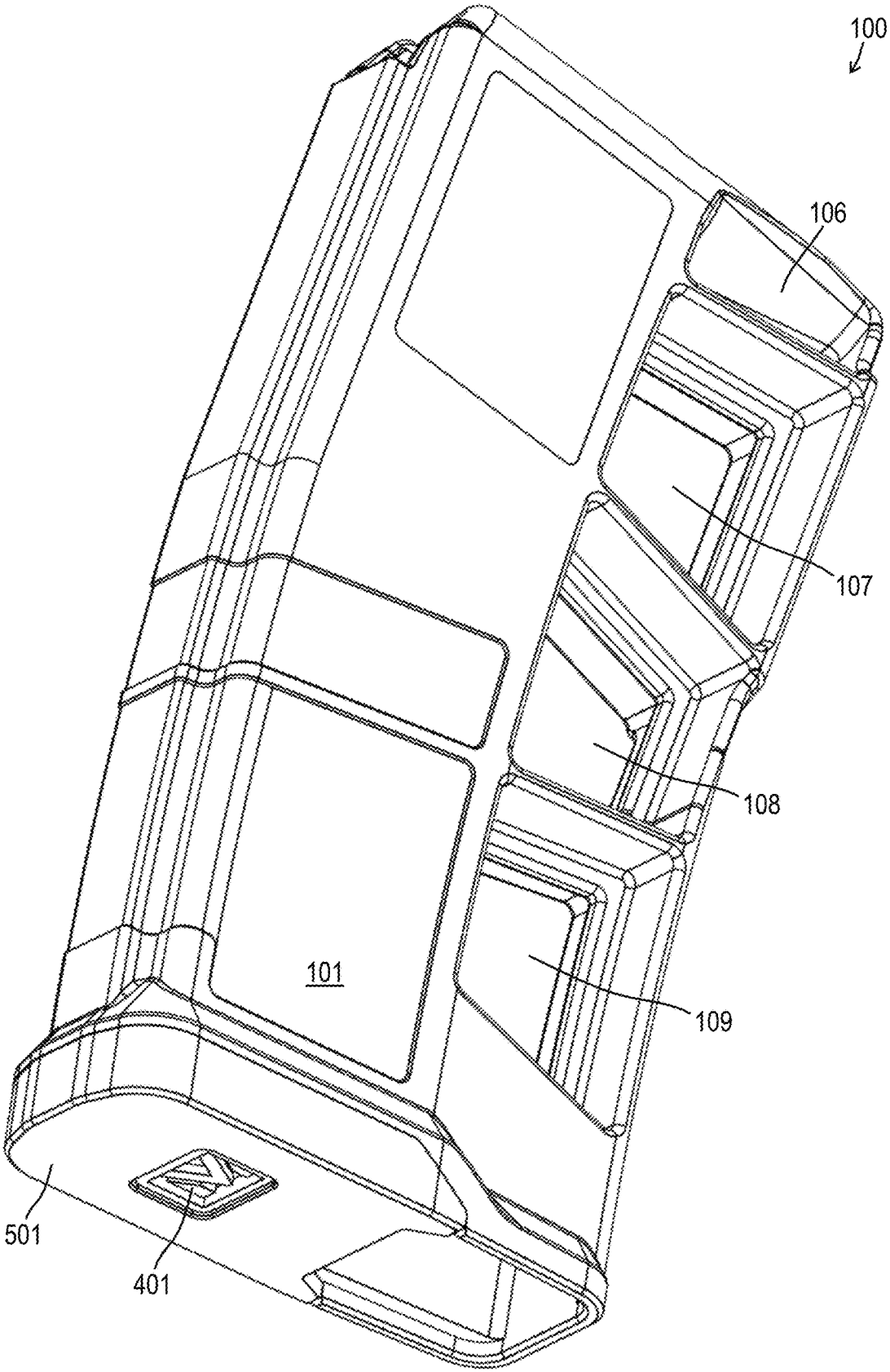
FIG. 1B is a rear right perspective view of the magazine assembly of FIG. 1A.
Figure 2A:
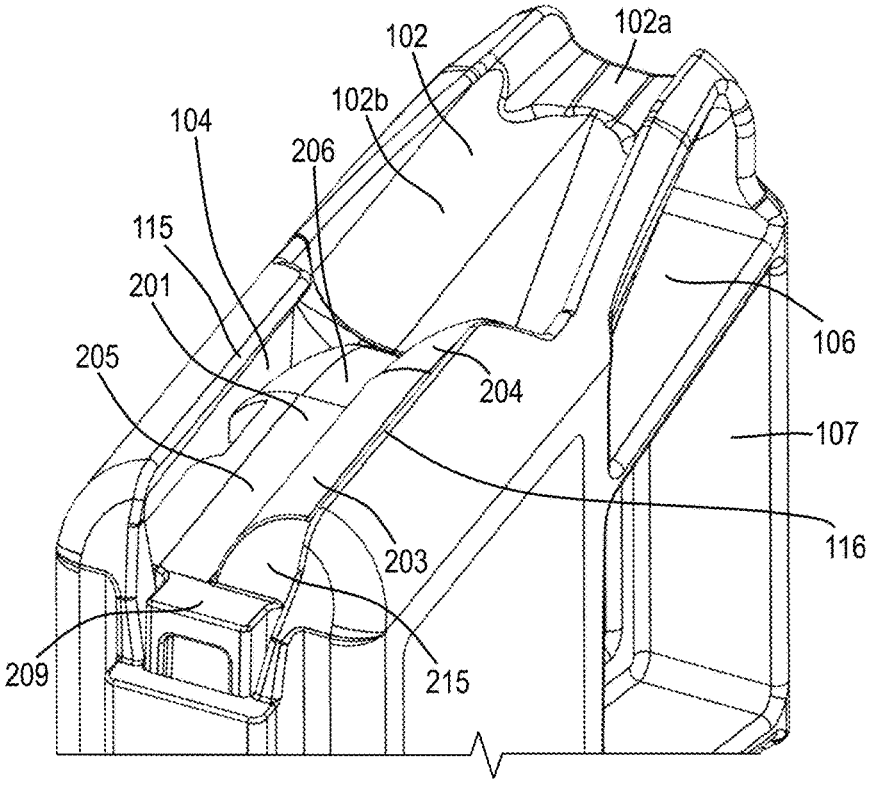
FIG. 2A is a rear partial perspective view of the magazine assembly of FIG. 1A without ammunition.
Figure 2B:
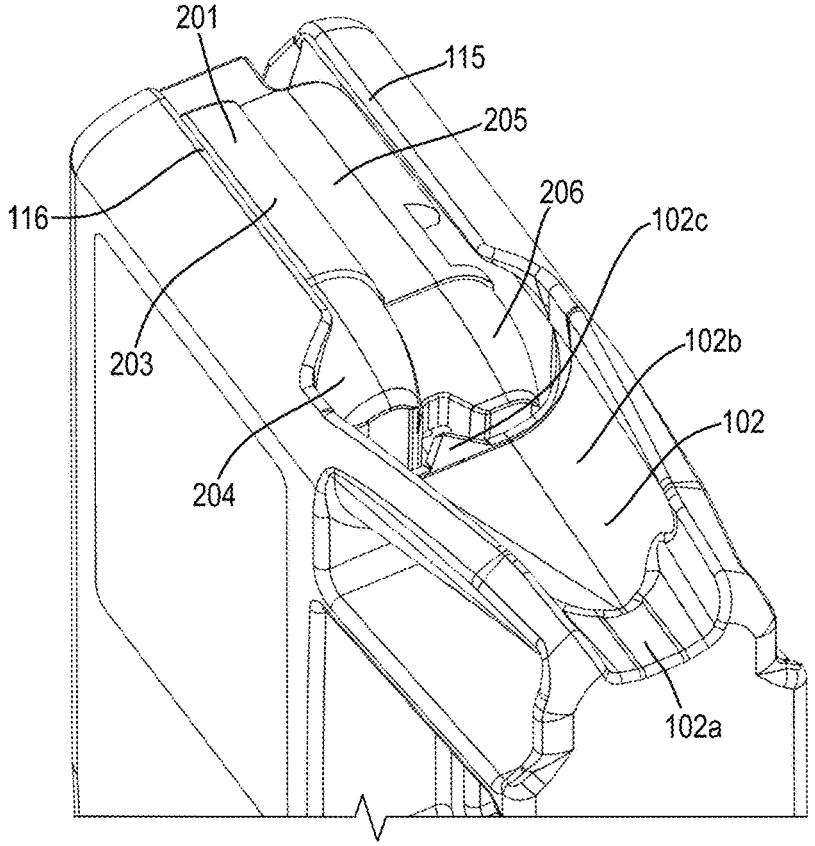
FIG. 2B is a front partial perspective view of the magazine assembly of FIG. 2A.
Figure 3:
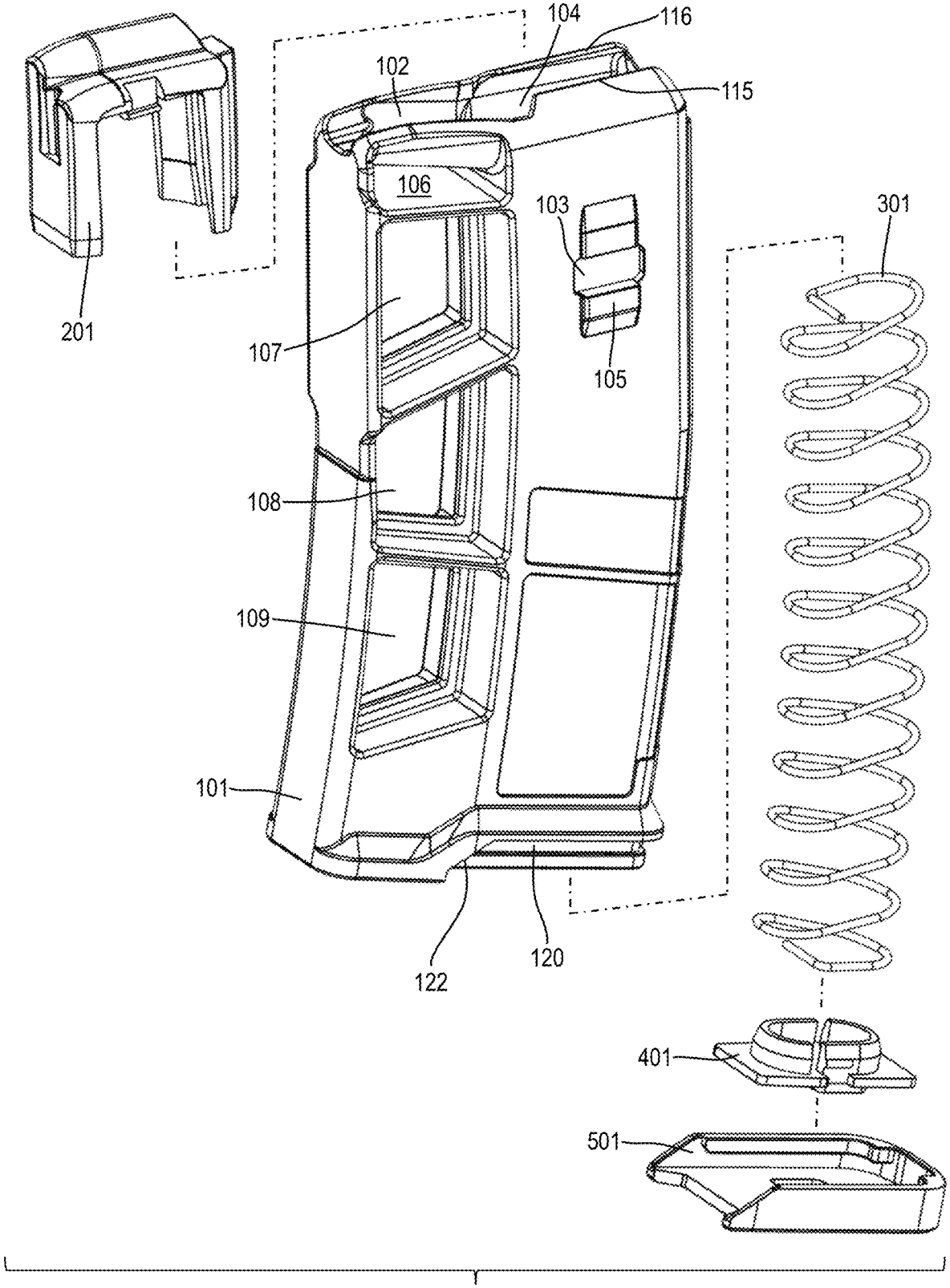
FIG. 3 is an exploded perspective view of the magazine assembly of FIG. 1A.
Figure 4A:
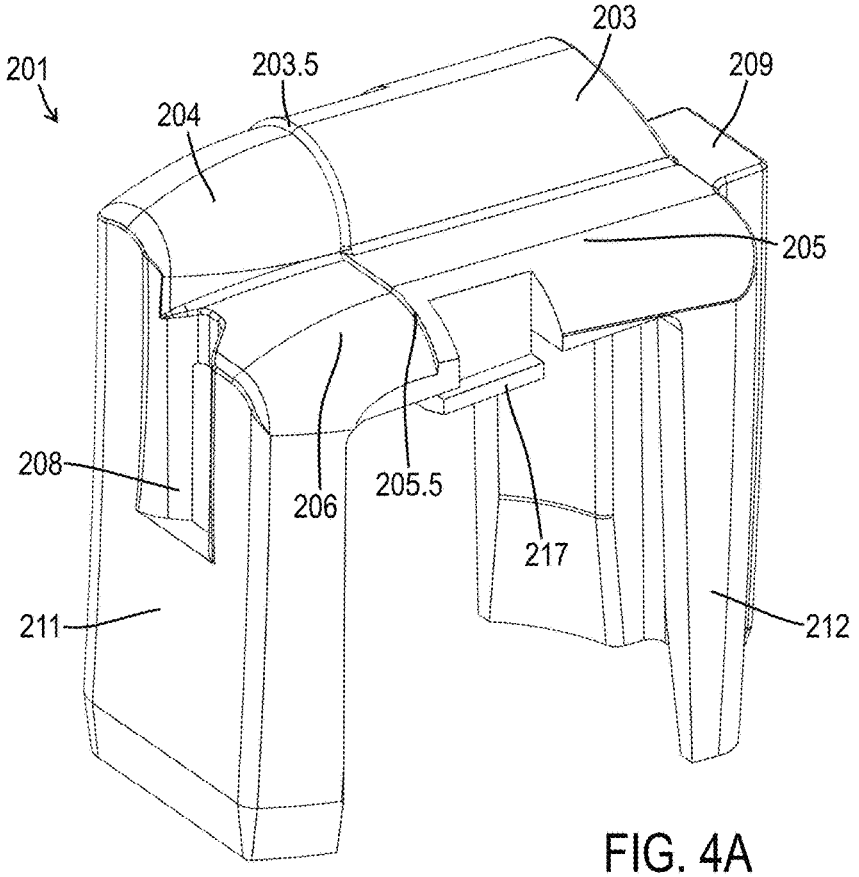
FIG. 4A is a front perspective view of a follower of the magazine assembly of FIG. 1A.
Figure 4B:
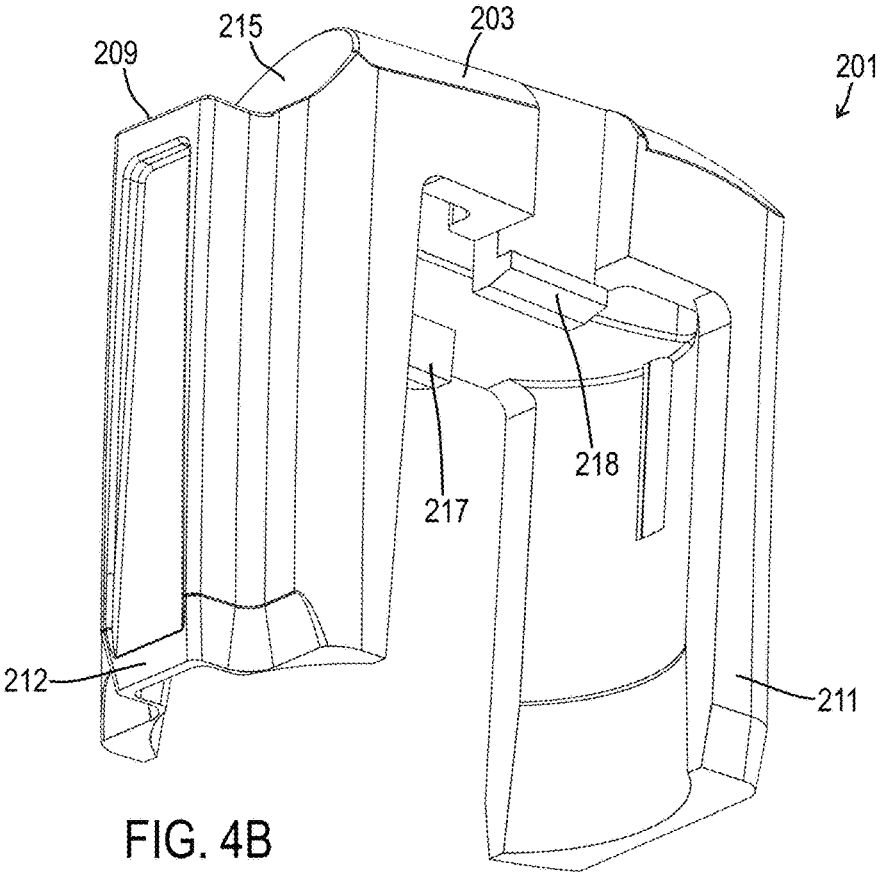
FIG. 4B is a rear perspective view of the follower of FIG. 4A.

As shown in FIGS. 4A and 4B, the upper surface of the follower 201 may include at least one convex portion for interfacing with cartridge(s) 10. The convex follower surface is designed to simulate the shape of cartridge(s) 10. The upper surface may have a top portion 203 and a bottom portion 205. The top portion 203 may have a convex shape and, in some cases, may have a curved shape. In some embodiments, the top portion 203 includes (i) an at least partially cylindrical shape between the trailing edge and a transition portion 203.5 and (ii) an at least partially conical portion 204 extending from the transition portion 203.5 to the leading edge. The top portion 203 may be designed to mimic the shape of a cartridge (i.e., a static cartridge attached to the top of the follower) where the transition portion 203.5 corresponds to the forward edge of the case and the initial exposed portion of the bullet. As shown in FIG. 2A, at the trailing end of the top portion 203, the upper surface may include a tapered portion 215 that extends downward and rearward. In some cases, the tapered portion 215 is approximately flat, but this is not always the case. The tapered portion 215 may reduce the effect of any potential contact between the bolt carrier group and the follower 215. In some cases, the tapered portion 215 may allow a cartridge 10 to tilt (where the rear end of the cartridge tilts downward) as the cartridge 10 exits the magazine assembly 100.

The bottom portion 205 may have a convex shape and, in some cases, may have a curved shape. The bottom portion 205 may include a curved portion (distal from the top portion 203) and a second portion with less curvature (or may be approximately flat) proximate to the top portion 203. In some embodiments, the bottom portion 205 includes (i) an at least partially cylindrical shape between the trailing edge and a transition portion 205.5 and (ii) an at least partially conical portion 206 extending from the transition portion 205.5 to the leading edge. The bottom portion 205 may be designed to mimic the shape of a cartridge (i.e., a static cartridge attached to the top of the follower) where the transition portion 205.5 corresponds to the forward edge of the case and the initial exposed portion of the bullet.

Figure 5A:
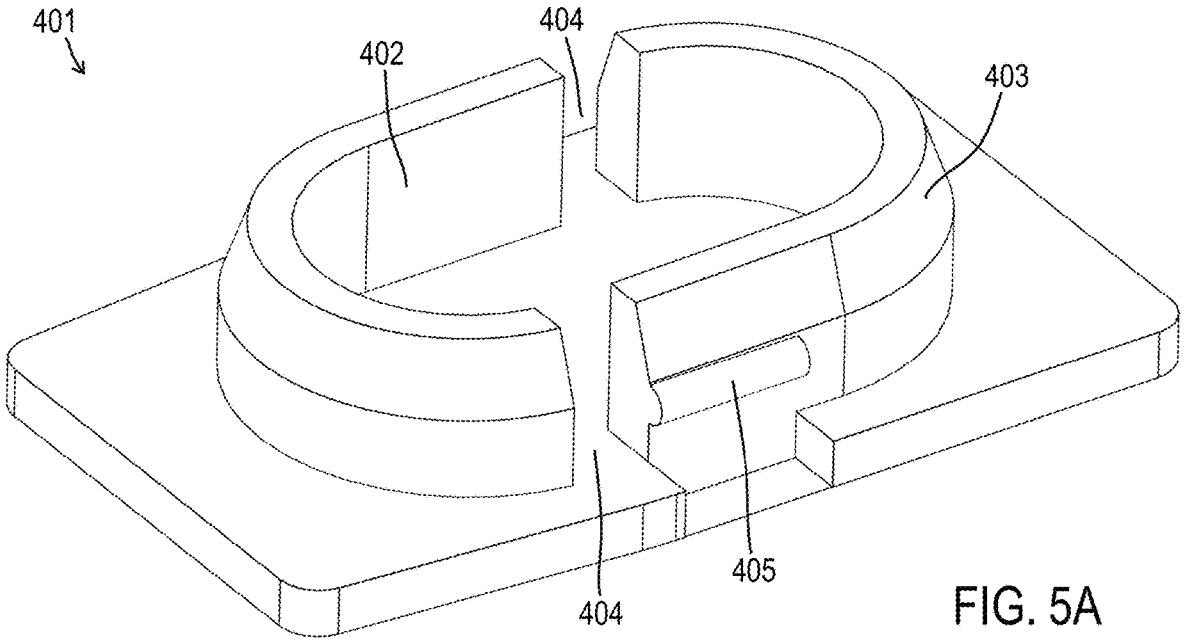
FIG. 5A is a front perspective view of a floorplate of the magazine assembly of FIG. 1A.
Figure 5B:
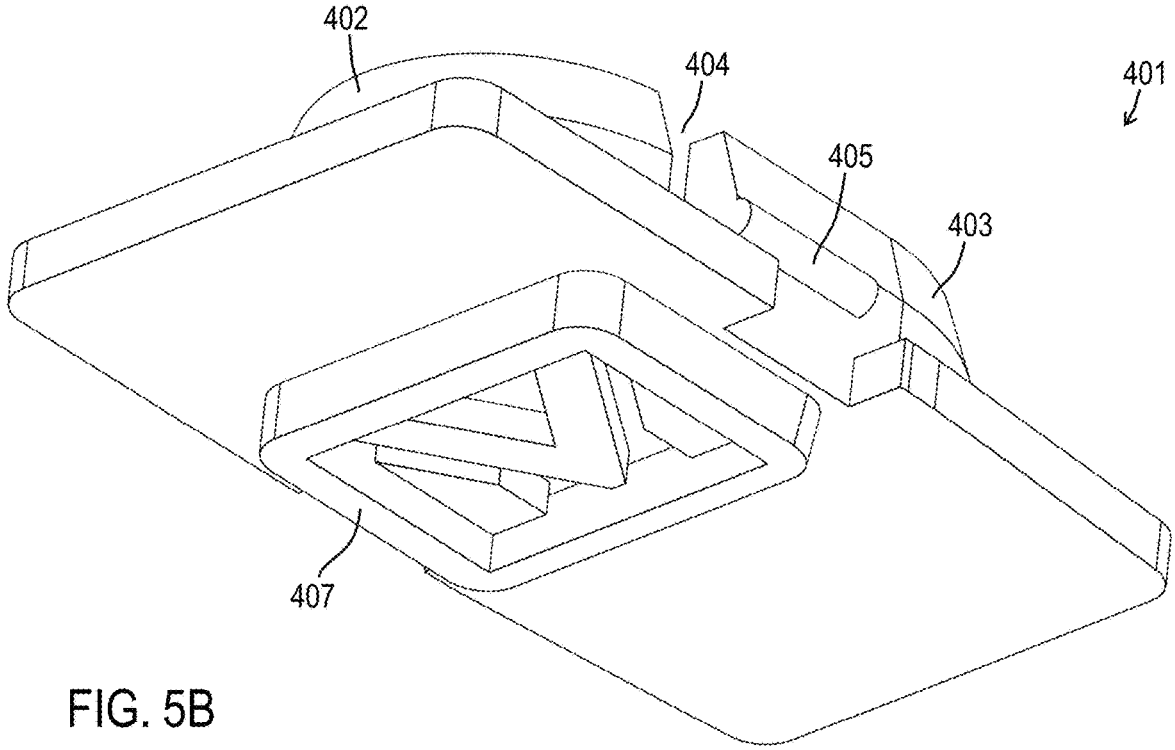
FIG. 5B is a rear perspective view of the floorplate of FIG. 5A.

The floorplate 401 is shown in FIGS. 5A and 5B and may include an upper protrusion 402, at least one opening 404, at least one protrusion 405, and a lower protrusion 407. The upper protrusion 402 may include a tapered portion 403. In some embodiments, the lower protrusion 407 engages a corresponding recess 504 of the baseplate 501, which retains the baseplate 501 in the closed or engaged configuration shown in the drawings. The protrusion 402 may be designed to fit within the lower end of the spring 301 and the at least one opening 404 may be configured such that a straight portion at the lower end of the spring 301 passes through. In addition, the at least one protrusion 405 may be designed to hold the lower end of the spring 301 such that the floorplate 401 remains attached to the lower end of the spring 301.

Figure 6A:
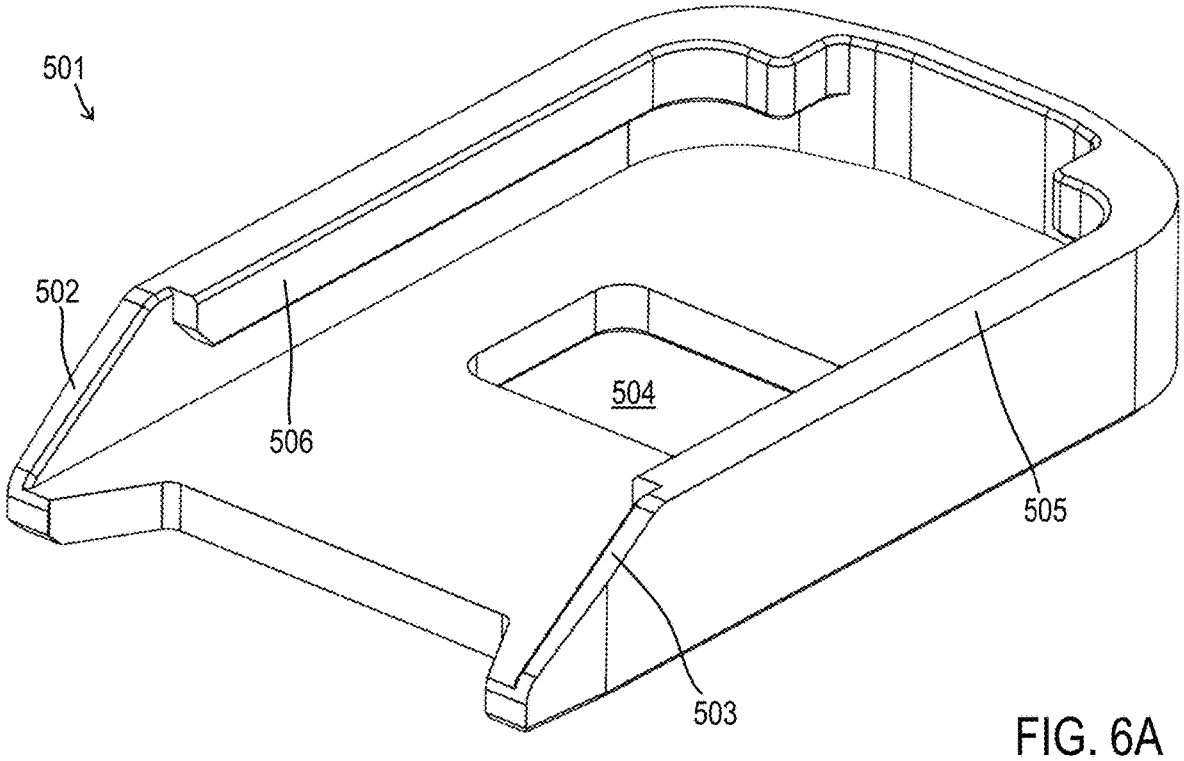
FIG. 6A is a front perspective view of a baseplate of the magazine assembly of FIG. 1A.
Figure 6B:
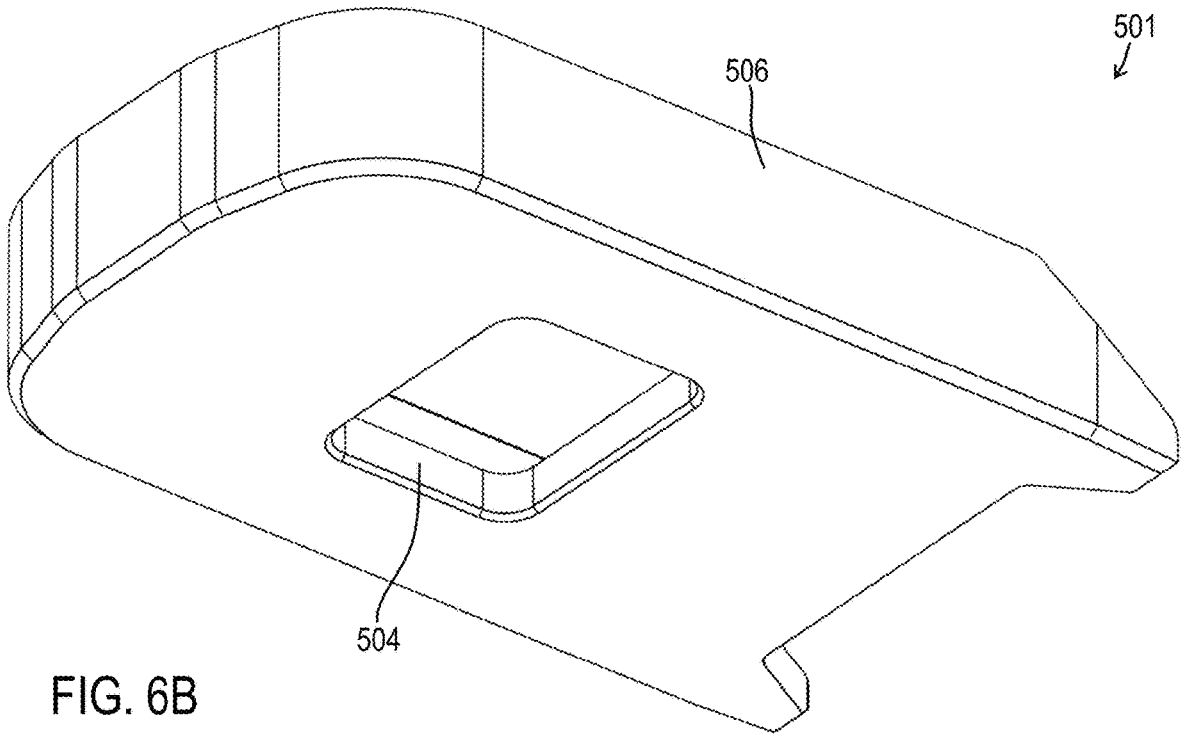
FIG. 6B is a rear perspective view of the baseplate of FIG. 6A.
Figure 7A:
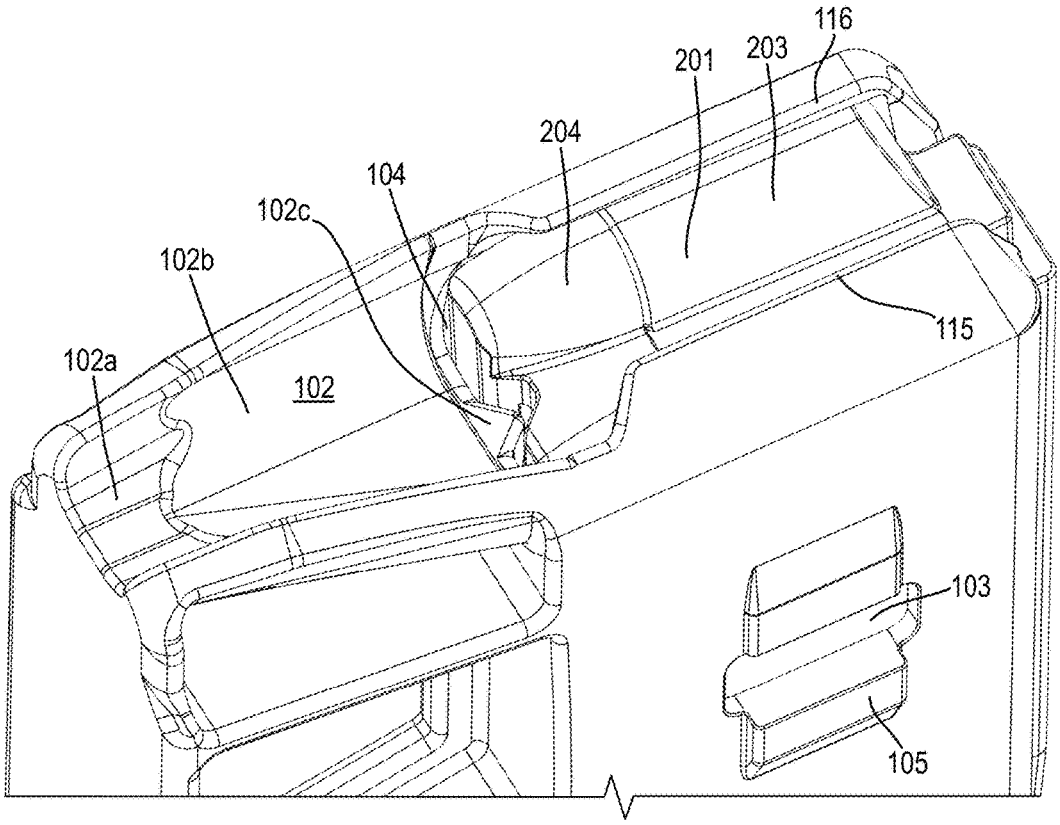
FIG. 7A is a front partial perspective view of the magazine assembly of FIG. 1A without ammunition.
Figure 7B:
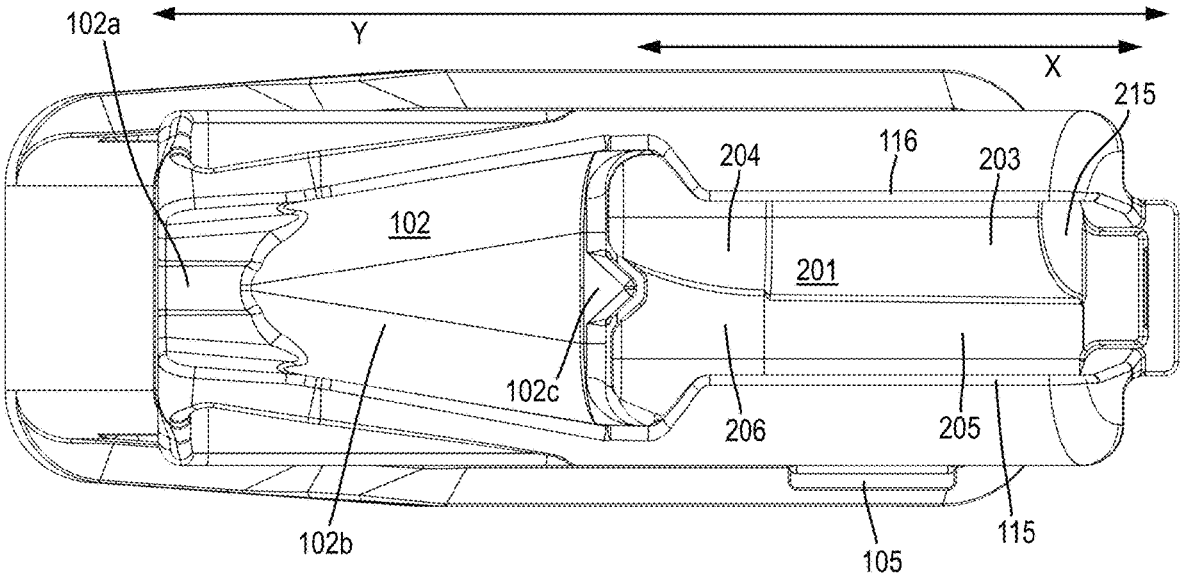
FIG. 7B is a top view of the magazine assembly of FIG. 7A.

The baseplate 501 is shown in FIGS. 6A and 6B and may include at least one bevel surface 502, 503, a recess 504, a first protrusion 505, and a second protrusion 506. As described above in the context of the floorplate 401, the recess 504 may be designed to engage with the lower protrusion 407 of the floorplate 401. This engagement may function to prevent the baseplate 501 from sliding out of the engaged configuration. In other words, the lower protrusion 407 may at least partially protrude into the recess 504 when the baseplate 501 is in the engaged configuration. Examples of the engaged configuration are shown in FIGS. 1B, 9B, 11B, 13B, and 15B. In some embodiments, in the engaged configuration, at least one of the first protrusion 505 and the second protrusion 506 engage a corresponding groove 120 of the magazine body 101 (see FIG. 3). The baseplate 501 may slide forward relative to the magazine body 101 until at least one of the bevel surfaces 502, 503 are in close proximity to and/or contact a corresponding surface 122 of the magazine body 101. Although the drawings show the recess 504 and the corresponding protrusion 407 as approximately rectangular with rounded corners, these features may have any appropriate shape including, but not limited to, square, circular, oval, elliptical, triangular, quadrilateral, pentagonal, hexagonal, heptagonal, octagonal, other polygonal, and/or any other appropriate shape.

As shown in FIGS. 8A-8C, 10, 12, 14, and 16, the magazine body 101 may optionally include an ejector 150. The ejector 150 is necessary if the bolt carrier group to be used in combination with the magazine assembly 100 does not include an ejector. For bolt carrier groups that do include an ejector or if an ejector is present elsewhere (i.e., in the firearm receiver), the magazine assembly 100 does not include the ejector. The ejector 150 may be connected and/or attached to the magazine assembly 100 and/or the magazine body 101. In some embodiments, the magazine body 101 includes an ejector 150 (see FIGS. 8A-8C, 10, 12, 14, and 16). The ejector 150 may be an integral feature of the magazine body 101. In these embodiments, the magazine body 101 may be a machined metallic part such that the ejector 150 is a machined feature. In some embodiments, the magazine body 101 is an ejection molded polymer part such that the ejector 150 is one of the features created during the injection molding manufacturing process. The ejector 150 may be a separate component that can be inserted into the magazine body 101. For example, the magazine body 101 may include a receptacle or cavity designed to receive the ejector 150. The ejector 150 may include at least one retaining feature for securing the ejector 150 in the appropriate position. In some cases, the ejector 150 includes barbs such that the ejector 150 can inserted and fixed into the appropriate position. In some cases, these feature(s) would prevent the ejector 150 from being removed after installation.

Figure 8A:
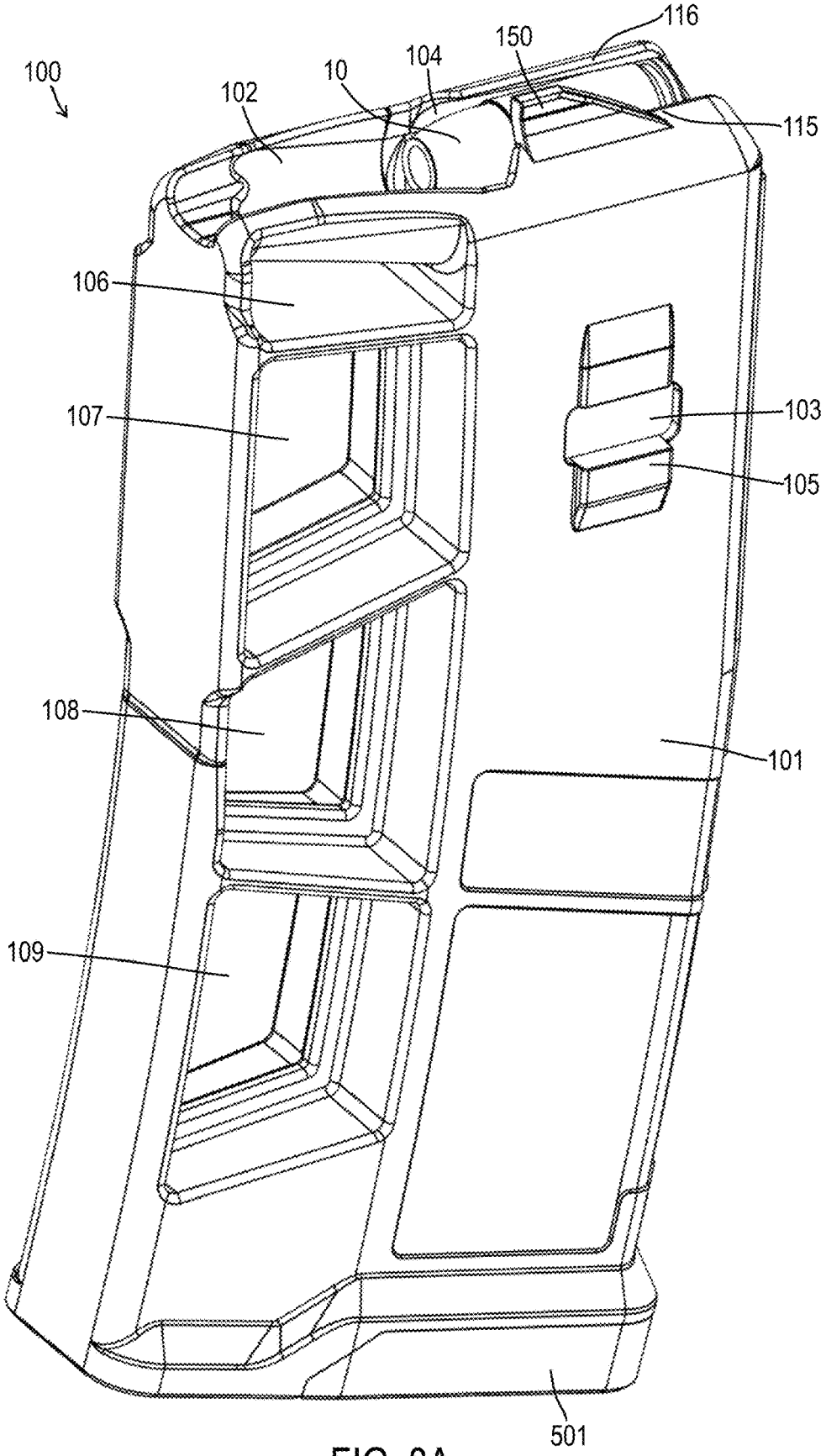
FIG. 8A is a front left perspective view of a magazine assembly with an ejector according to certain embodiments of the present invention.
Figure 8B:
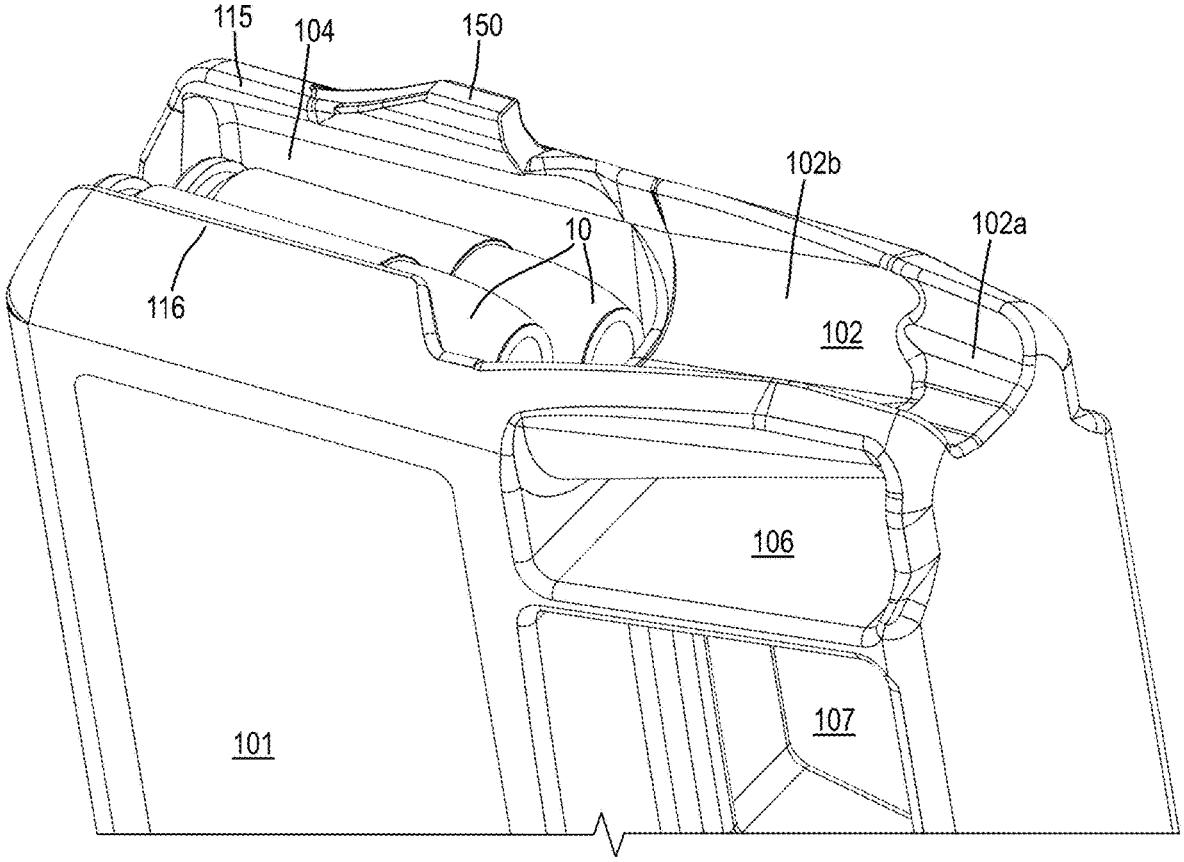
FIG. 8B is a front partial perspective view of the magazine assembly of FIG. 8A.
Figure 8C:
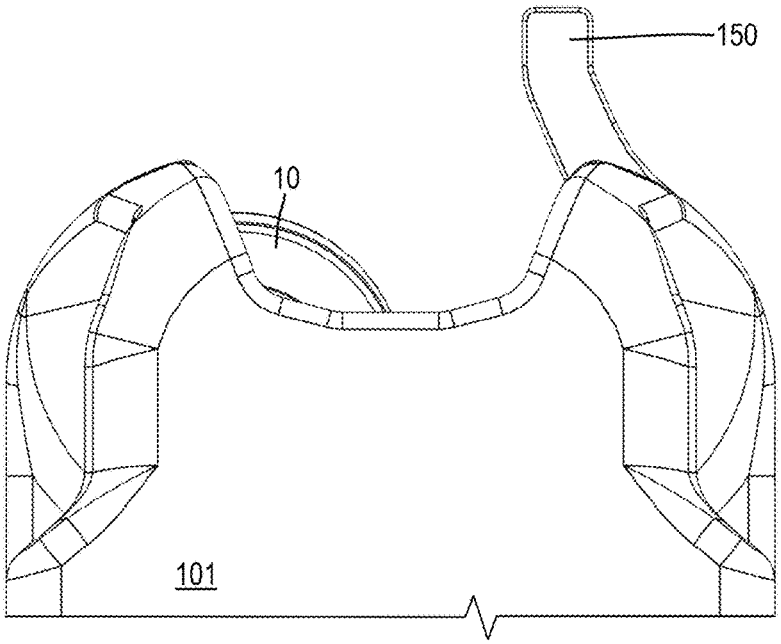
FIG. 8C is a partial front view of the magazine assembly of FIG. 8A.

In some embodiments, the ejector 150 extends from the magazine body 101 as a portion of or adjacent to the feed lip 115. The ejector 150 may include at least a portion that has an oblique angle relative to a vertical direction of the magazine assembly 100. In some embodiments, the angle of this portion for the ejector 150 is between 20° and 30° relative to vertical. As shown in FIG. 8C, the ejector 150 may include a portion at or near the upper end of the ejector 150 that is approximately vertical. This approximately vertical portion may be designed to interface with a corresponding groove in a bolt or bolt carrier group.

Figure 17A:
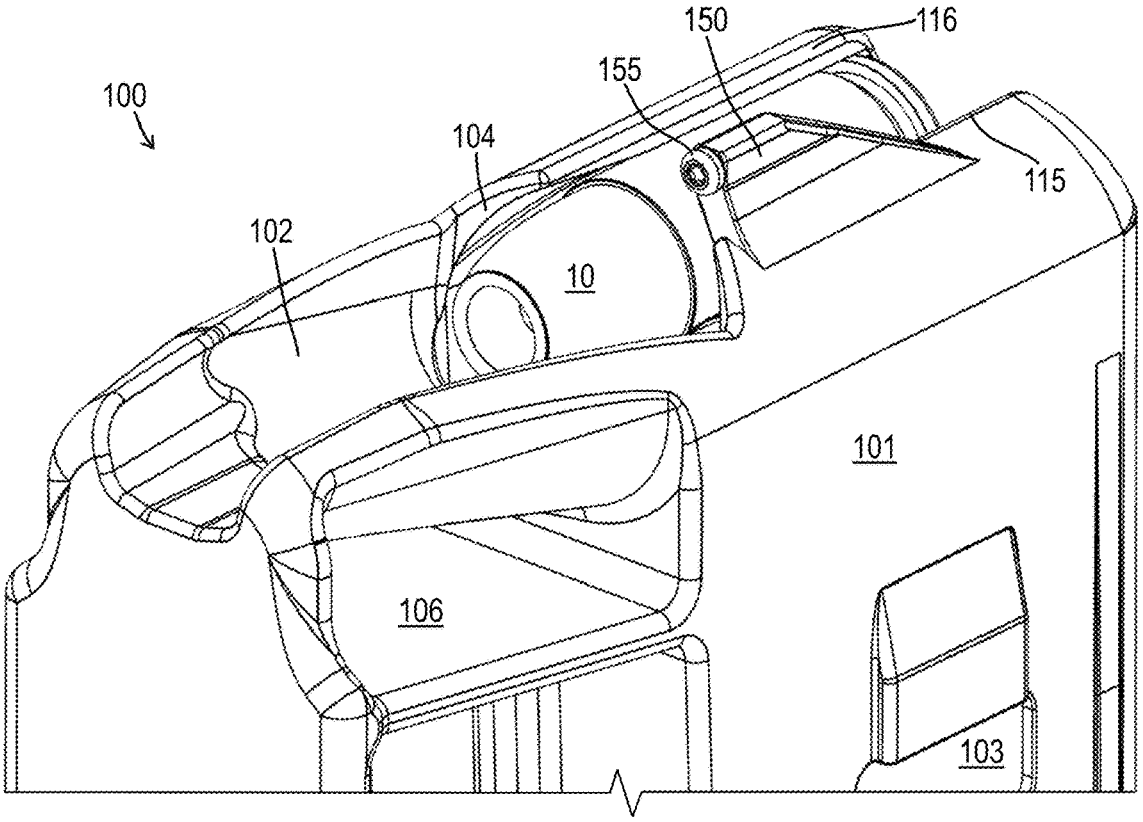
FIG. 17A is a front partial perspective view of a magazine assembly with an ejector according to certain embodiments of the present invention.
Figure 17B:
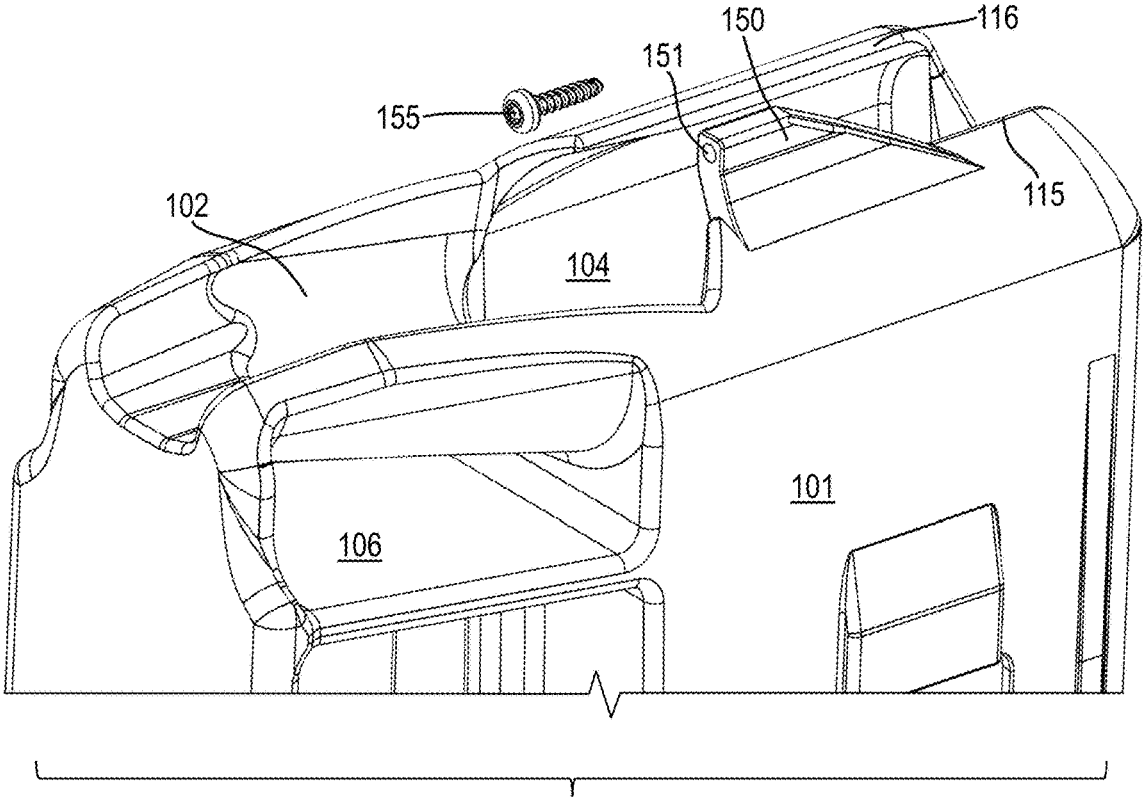
FIG. 17B is an exploded partial perspective view of the magazine body of the magazine assembly of FIG. 17A.

As shown in FIGS. 17A and 17B, the ejector 150 may include a hole 151 and an insert 155. In some embodiments, the insert 155 is a sacrificial component designed to absorb impact that occurs when the ejector 150 contacts a cartridge 10 (or a cartridge case after the cartridge 10 has been fired) such that the insert 155 can be replaced after an appropriate interval. The insert 155 may be the same material as the magazine body 101 and/or the ejector 150 (i.e., either a metallic or polymer material). In other embodiments, the insert 155 is a different material than the magazine body 101 and/or the ejector 150. The insert 155 may be designed to function as a soft material that absorbs impact and deflects via elastic deformation. This may include a polymer material, a rubberized polymer material, or any other appropriate material. In other embodiments, the insert 155 may be designed to function as a hard material that takes the impact of the cartridge 10 (or a cartridge case after the cartridge 10 has been fired) that protects and prevents the ejector 150 from absorbing impact. This may include a metallic material, a hard polymer material, or any other appropriate material. Although the insert 155 is illustrated as a fastener, the insert 155 may be a simple post or cylindrical shape with or without a head. The insert 155 may be a friction fit in the hole 151, may be threaded into the hole 151, may be secured using a chemical fastener (i.e., adhesive), and/or may be secured using any other appropriate arrangement. The insert 155 may be attached in a different manner than the illustrated embodiments. For example, the insert 155 may be clamped onto or wrapped around the exterior of the ejector 150. The insert 155 may be designed as adjustable such that the offset from the front of the ejector 150 can change to adjust timing for ejection.

The components of any of the components described herein may be formed of materials including, but not limited to, thermoplastic, carbon composite, plastic, nylon, polyethylene, polyetherimide, polypropylene, polyvinyl chloride, steel, aluminum, stainless steel, high strength aluminum alloy, other plastic or polymer materials, other metallic materials, other composite materials, or other similar materials. Moreover, the components of the devices described herein may be attached to one another via suitable fasteners, which include, but are not limited to, screws, bolts, rivets, welds, over-molding, co-molding, injection molding, or other mechanical or chemical fasteners.

Different arrangements of the components depicted in the drawings or described above, as well as components and steps not shown or described, are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A magazine assembly comprising:
a magazine body;
a follower disposed at least partially within the magazine body;
a spring disposed within the magazine body;
an ejector;
a floorplate disposed at a lower end of the spring; and
a baseplate attached to a lower end of the magazine body, wherein:
the ejector comprises an insert protruding from a forward surface of the ejector; and
the magazine body comprises an internal cavity for holding at least one cartridge such that a front to rear length of the internal cavity is approximately half of an overall front to rear length of the magazine body.

2. The magazine assembly of claim 1, wherein the magazine body comprises a feed ramp near an upper end of the magazine body such that the feed ramp extends from a forward end of the internal cavity to the forwardmost portion of the magazine body.

3. The magazine assembly of claim 2, wherein at least a portion of the feed ramp comprises a curved and approximately conical shape.

4. The magazine assembly of claim 1, wherein the follower comprises an upper surface with a top portion and a bottom portion.

5. The magazine assembly of claim 4, wherein at least a part of the top portion comprises a convex shape.

6. The magazine assembly of claim 1, wherein the ejector extends up from a feed lip of the magazine body.

7. The magazine assembly of claim 1, wherein the ejector comprises an integral portion of the magazine body.

8. The magazine assembly of claim 1, wherein the insert of the ejector comprises at least one selected from the group consisting of a polymer material, a rubberized polymer material, a metallic material, or a hard polymer material.

9. The magazine assembly of claim 1, wherein the insert of the ejector is adjustable such that an offset from the ejector can change to adjust timing for ejection.

10. A magazine assembly comprising:
a magazine body comprising a feed ramp;
a follower disposed at least partially within the magazine body;
a spring disposed within the magazine body;
an ejector;
a floorplate disposed at a lower end of the spring; and
a baseplate attached to a lower end of the magazine body, wherein:
the ejector comprises an insert protruding from a forward surface of the ejector; and
the feed ramp is disposed near an upper end of the magazine body such that the feed ramp comprises a front to rear length that is approximately half of an overall front to rear length of the magazine body.

11. The magazine assembly of claim 10, wherein at least a portion of the feed ramp comprises a curved and approximately conical shape.

12. The magazine assembly of claim 10, wherein the follower comprises an upper surface with a top portion and a bottom portion.

13. The magazine assembly of claim 12, wherein at least a part of the top portion comprises a convex shape.

14. The magazine assembly of claim 10, wherein the ejector extends up from a feed lip of the magazine body.

15. The magazine assembly of claim 10, wherein the ejector comprises an integral portion of the magazine body.

16. The magazine assembly of claim 10, wherein the of the ejector comprises at least one selected from the group consisting of a polymer material, a rubberized polymer material, a metallic material, or a hard polymer material.

17. The magazine assembly of claim 10, wherein the insert of the ejector is adjustable such that an offset from the ejector can change to adjust timing for ejection.

18. A magazine assembly comprising:
a magazine body;
a follower disposed at least partially within the magazine body;
a spring disposed within the magazine body;
a floorplate disposed at a lower end of the spring; and
a baseplate attached to a lower end of the magazine body, wherein:
the magazine body comprises an ejector extending up from the magazine body; and
the ejector comprises an insert protruding from a forward surface of the ejector.

19. The magazine assembly of claim 18, wherein the ejector extends up from a feed lip of the magazine body.

20. The magazine assembly of claim 18, wherein the magazine body comprises an internal cavity for holding at least one cartridge such that a front to rear length of the internal cavity is approximately half of an overall front to rear length of the magazine body.

* * * * *